US007512375B2

(12) United States Patent
Horio

(10) Patent No.: US 7,512,375 B2
(45) Date of Patent: Mar. 31, 2009

(54) IMAGE FORMING METHOD AND APPARATUS CAPABLE OF AUTOMATICALLY CONVEYING DOCUMENTS

(75) Inventor: Toru Horio, Aichi-ken (JP)

(73) Assignee: Ricoh Company, Ltd., Tokyo (JP)

( * ) Notice: Subject to any disclaimer, the term of this patent is extended or adjusted under 35 U.S.C. 154(b) by 474 days.

(21) Appl. No.: 11/227,567

(22) Filed: Sep. 16, 2005

(65) Prior Publication Data

US 2006/0062615 A1 Mar. 23, 2006

(30) Foreign Application Priority Data

Sep. 17, 2004 (JP) ..... 2004-271593
Jun. 24, 2005 (JP) ..... 2005-185188

(51) Int. Cl.
*G03G 15/00* (2006.01)

(52) U.S. Cl. ..... 399/374; 399/369; 399/370; 399/373

(58) Field of Classification Search ..... 399/374, 399/369, 370, 373
See application file for complete search history.

(56) References Cited

U.S. PATENT DOCUMENTS 6,648,320 B2 * 11/2003 Iino et al. ..... 271/3.15

FOREIGN PATENT DOCUMENTS

| | | |
|---|---|---|
| JP | 10-181942 | 7/1998 |
| JP | 2000-169017 | 6/2000 |
| JP | 2003-002546 | 1/2003 |

* cited by examiner

*Primary Examiner*—Anthony H Nguyen
*Assistant Examiner*—Andy L Pham
(74) *Attorney, Agent, or Firm*—Oblon, Spivak, McClelland, Maier & Neustadt, P.C.

(57) ABSTRACT

An image forming apparatus includes an automatic document conveying apparatus including a table, first and second conveyance paths, a scanning device, and first and second switchback mechanisms. A document of the document bundle set on the table is reversed and conveyed by the first conveyance path through the scanning device with its first surface facing the scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from a sensor included in the first conveyance path. Thereafter, the document is reversed and conveyed by the first conveyance path to the scanning device to have its first surface scanned. A method of automatically conveying documents is also described.

21 Claims, 19 Drawing Sheets

IMAGE FORMING METHOD AND APPARATUS CAPABLE OF AUTOMATICALLY CONVEYING DOCUMENTS

CROSS REFERENCE TO RELATED APPLICATIONS

This application claims priority to Japanese patent application nos. 2004-271593 filed on Sep. 17, 2004 and 2005-185188 filed on Jun. 24, 2005, the entire contents of each of which are hereby incorporated by reference herein.

BACKGROUND OF THE INVENTION

1. Field of the Invention

The present invention relates to an image forming method and apparatus capable of automatically conveying documents, and more particularly to an image forming method and apparatus capable of duplex (i.e., double-side) scanning at an increased speed and of automatically conveying documents in a convenient manner.

2. Discussion of the Background Arts

In a background image forming apparatus or image scanning apparatus, such as a copier, a printer, and a facsimile machine, various types of document conveying devices are used for conveying documents to be scanned. In a commonly used background document conveying device, a pick-up device such as a pick-up roller picks up documents set on the document conveying device, and one of the documents is separated from remaining documents and conveyed by a separation belt and a reverse roller provided at downstream positions of the pick-up roller in a document conveying direction.

The document thus separated from the remaining documents is conveyed onto a contact glass and scanned. In this background document conveying device, however, there is a time loss before a scanner carriage returns to its scanning start position. This time loss reduces CPM (copies per minute, i.e., the number of copies output in one minute by a copier), compared with in a case in which a printing operation is exclusively performed. Further, to discharge scanned documents in a page order, the documents are discharged on an external tray. As a result, a size of the image forming apparatus is increased.

In light of the above, an image forming apparatus using a sheet-through system of conveying documents over a fixed scanner carriage is expected to become mainstream. According to the system, an interval between one document and its subsequent document can be controlled. If this interval is reduced to the minimum value, therefore, the CPM can be increased up to a CPU value obtained in the printing operation. In addition, the documents are discharged to a document discharging and stacking mechanism provided under a document table on which the documents are set. Therefore, the external tray is unnecessary, and the image forming apparatus can be reduced in size.

In an image forming apparatus such as a copier, for example, productivity of duplex copies, as compared with productivity of simplex (i.e., single-sided) copies, is an important factor, as well as an output speed of the simplex copies. To increase the productivity of the duplex copies, reduction in a time interval between scanning one document and scanning its subsequent document is a key issue.

In a copying operation of a duplex document, after a back surface of the duplex document is scanned, the duplex document needs to be discharged with its front surface facing downward so that discharged documents are arranged in the page order. In a typical sheet-reversing and switchback operation, both surfaces of the duplex document are scanned, and then the duplex document is conveyed once again over a scanning position before being discharged. That is, the duplex document is conveyed over the scanning position not for being scanned but for being reversed. Therefore, the duplex document needs to be reversed three times in total, i.e., for scanning both surfaces of the duplex document and for arranging the duplex document in the page order.

In light of this, there is another background image forming apparatus which increases the productivity of duplex copying operation by combining a sheet-reversing and switchbacking device and a sheet-reversing and discharging device provided at downstream positions of a scanning mechanism, without reversing each duplex document three times. With this configuration, duplex documents are discharged with each of them reversed and arranged in the page order without being conveyed through the scanning mechanism.

To reverse and switch back one document in this image forming apparatus, however, the document needs to be discharged before scanning of its subsequent document starts. Thus, a time interval between scanning of the document and scanning of its subsequent document may not be sufficiently reduced. Further, as a size of a document increases, a longer time is taken before scanning the front surface of its subsequent document starts.

SUMMARY OF THE INVENTION

This patent specification describes an image forming apparatus. In one example, an image forming apparatus includes an automatic document conveying apparatus which includes a table, first and second conveyance paths, a scanning device, and first and second switchback mechanisms. The table holds thereon a document bundle. The first conveyance path reverses and conveys a document of the document bundle, and includes a sensor for detecting a size of the document. The scanning device scans the document conveyed by the first conveyance path. Each of the first and second switchback mechanisms is provided at a downstream position of the scanning device to switch back and convey the document. The second switchback mechanism communicates with the first conveyance path. The second conveyance path guides the document from the scanning device to any one of the first and second switchback mechanisms, reverses and conveys the document from the first switchback mechanism to the second switchback mechanism, and discharges the document. The document is reversed and conveyed by the first conveyance path through the scanning device with a first surface of the document facing the scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor. Thereafter, the document is reversed and conveyed by the first conveyance path to the scanning device to have the first surface of the document scanned.

In the image forming apparatus, after the first surface of the document is scanned, the document may be guided to the second switchback mechanism by the second conveyance path, switched back by the second switchback mechanism, and reversed and conveyed by the first conveyance path to the scanning device to have a second surface of the document scanned.

In the image forming apparatus, the first switchback mechanism may include a first roller pair, a second roller pair, and a discharge path. The first roller pair may rotate to convey the document sent from the scanning device into the first switchback mechanism. The second roller pair may be provided at a downstream position of the first roller pair to rotate in any one of first and second directions. The discharge path may discharge the document conveyed by the second roller pair from the first switchback mechanism. The first and second roller pairs may rotate in the first direction to receive a first document into the first switchback mechanism. Further, after a rear end of the first document passes the first roller pair, the second roller pair may start rotating in the second direction to discharge the first document from the first switchback mechanism while receiving a second document sent from the scanning device into the first switchback mechanism.

This patent specification further describes a method of automatically conveying documents. In one example, a method of automatically conveying documents includes: setting a document bundle on a document table; reversing and conveying a document of the document bundle by a first conveyance path through a scanning device with a first surface of the document facing the scanning device to detect a size of the document based on information sent from a sensor included in the first conveyance path; guiding the document to a first switchback mechanism by the second conveyance path; switching back the document by the first switchback mechanism; reversing and conveying the document to a second switchback mechanism by the second conveyance path; switching back the document by the second switchback mechanism; reversing and conveying the document by the first conveyance path to the scanning device; scanning the first surface of the document by the scanning device; guiding the document to the first switchback mechanism by the second conveyance path; switching back the document by the first switchback mechanism; and reversing and discharging the document by the second conveyance path.

In the method, the scanning step may further include: guiding the document to the second switchback mechanism by the second conveyance path upon completion of scanning of the first surface of the document; switching back the document by the second switchback mechanism; reversing and conveying the document by the first conveyance path to the scanning device; and scanning a second surface of the document by the scanning device.

In the method, the step of switching back by the first switchback mechanism may further include: rotating a first roller pair and a second roller pair provided at a downstream position of the first roller pair in a first direction of receiving a first document into the first switchback mechanism; rotating, after a rear end of the first document passes the first roller pair, the second roller pair in a second direction of discharging the first document from the first switchback mechanism; and discharging the first document from the first switchback mechanism through a discharge path while receiving a second document sent from the scanning device into the first switchback mechanism.

This patent specification further describes an image scanning apparatus. In one example, an image scanning apparatus includes an automatic document conveying apparatus which includes a table, first and second conveyance paths, a scanning device, and first and second switchback mechanisms. The table holds thereon a document bundle. The first conveyance path reverses and conveys a document of the document bundle, and includes a sensor for detecting a size of the document. The scanning device scans the document conveyed by the first conveyance path. Each of the first and second switchback mechanisms is provided at a downstream position of the scanning device to switch back and convey the document. The second switchback mechanism communicates with the first conveyance path. The second conveyance path guides the document from the scanning device to any one of the first and second switchback mechanisms, reverses and conveys the document from the first switchback mechanism to the second switchback mechanism, and discharges the document. The document is reversed and conveyed by the first conveyance path through the scanning device with a first surface of the document facing the scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor. Thereafter, the document is reversed and conveyed by the first conveyance path to the scanning device to have the first surface of the document scanned.

In the image scanning apparatus, after the first surface of the document is scanned, the document may be guided to the second switchback mechanism by the second conveyance path, switched back by the second switchback mechanism, and reversed and conveyed by the first conveyance path to the scanning device to have a second surface of the document scanned.

In the image scanning apparatus, the first switchback mechanism may include a first roller pair, a second roller pair, and a discharge path. The first roller pair may rotate to convey the document sent from the scanning device into the first switchback mechanism. The second roller pair may be provided at a downstream position of the first roller pair to rotate in any one of first and second directions. The discharge path may discharge the document conveyed by the second roller pair from the first switchback mechanism. The first and second roller pairs may rotate in the first direction to receive a first document into the first switchback mechanism. Further, after a rear end of the first document passes the first roller pair, the second roller pair may start rotating in the second direction to discharge the first document from the first switchback mechanism while receiving a second document sent from the scanning device into the first switchback mechanism.

This patent specification further describes an automatic document conveying apparatus. In one example, an automatic document conveying apparatus includes a table, first and second conveyance paths, and first and second switchback mechanisms. The table holds thereon a document bundle. The first conveyance path reverses and conveys a document of the document bundle to a scanning position where the document is scanned by an external scanning device. Further, the first conveyance path includes a sensor for detecting a size of the document. Each of the first and second switchback mechanisms is provided at a downstream position of the scanning position to switch back and convey the document. The second switchback mechanism communicates with the first conveyance path. The second conveyance path guides the document from the scanning device to any one of the first and second switchback mechanisms, reverses and conveys the document from the first switchback mechanism to the second switchback mechanism, and discharges the document. The document is reversed and conveyed by the first conveyance path through the scanning position with a first surface of the document facing the external scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor. Thereafter, the document is reversed and conveyed by the first conveyance path to the scanning position to have the first surface of the document scanned.

In the automatic document conveying apparatus, after the first surface of the document is scanned, the document may be guided to the second switchback mechanism by the second conveyance path, switched back by the second switchback mechanism, and reversed and conveyed by the first conveyance path to the scanning position to have a second surface of the document scanned.

In the automatic document conveying apparatus, the first switchback mechanism may include a first roller pair, a second roller pair, and a discharge path. The first roller pair may rotate to convey the document sent from the scanning position into the first switchback mechanism. The second roller pair may be provided at a downstream position of the first roller pair to rotate in any one of first and second directions. The discharge path may discharge the document conveyed by the second roller pair from the first switchback mechanism. The first and second roller pairs may rotate in the first direction to receive a first document into the first switchback mechanism. Further, after a rear end of the first document passes the first roller pair, the second roller pair may start rotating in the second direction to discharge the first document from the first switchback mechanism while receiving a second document sent from the scanning position into the first switchback mechanism.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
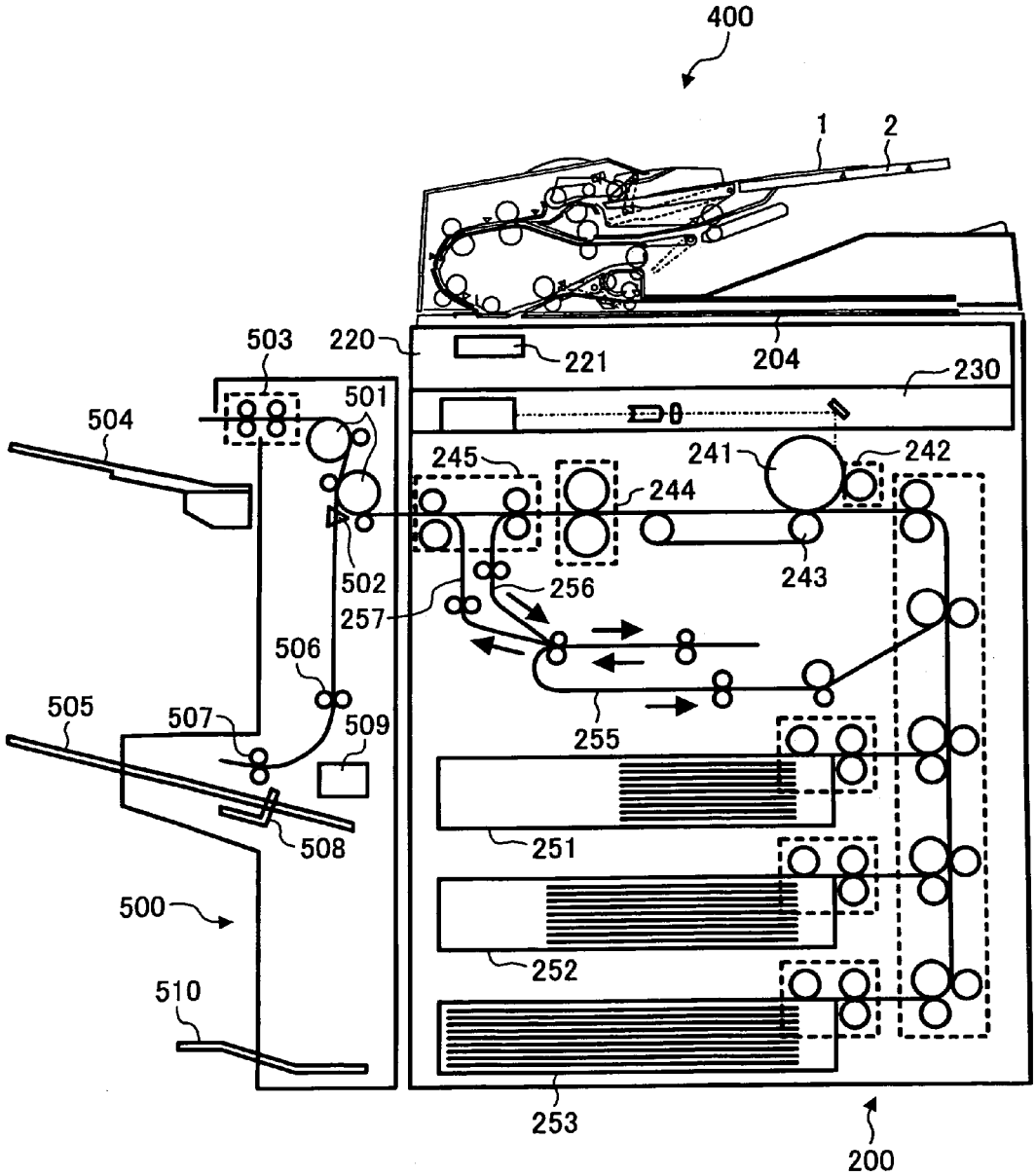
FIG. 1 is a side sectional view of an image forming apparatus according to an exemplary embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner. Referring now to the drawings, wherein like reference numerals designate identical or corresponding parts throughout the several views, particularly to FIG. 1, a configuration and functions of an image forming apparatus 200 according to an exemplary embodiment of the present invention are described.

FIG. 1 illustrates a schematic view of an overall configuration of the image forming apparatus 200 according to an electrographic method. The image forming apparatus 200 includes a scanning mechanism 220, a writing mechanism 230, a photoconductor 241, a development mechanism 242, a sheet-conveying belt 243, a fixing mechanism 244, a sheet-discharging mechanism 245, sheet-feeding trays 251 to 253, a duplex sheet-feeding mechanism 255, a duplex sheet-feeding path 256, and a sheet-reversing and discharging path 257. The scanning mechanism 220 includes a scanning device 221, a slit glass 202 (illustrated in FIG. 2), a document scale 203 (illustrated in FIG. 2), and a platen glass 204.

The image forming apparatus 200 according to this exemplary embodiment of the present invention is provided with an automatic document conveying apparatus (i.e., automatic document feeder, hereinafter referred to as ADF) 400. A configuration and functions of the ADF 400 are later described in detail.

The image forming apparatus 200 according to this exemplary embodiment of the present invention is further provided with a finisher 500. The finisher 500 includes regular sheet-discharging rollers 501, a switching plate 502, sheet-conveying roller pairs 503, 506, and 507, a regular sheet-discharge tray 504, a stapling table 505, a jogger 508, a stapler 509, and a stapled-sheet discharge tray 510.

An operation of the image forming apparatus 200 is described. In the image forming apparatus 200, a document set on the ADF 400 is conveyed to the fixed scanning device 221 of the scanning mechanism 220, and the document is scanned by the scanning device 221 while being conveyed at a predetermined speed. Then, an image of the thus conveyed and scanned document is transferred to a recording medium (i.e., copy job).

An operation of conveying and scanning a document is first described for each of cases of a duplex document scanning mode and a simplex document scanning mode.

In the duplex document scanning mode, the document bundle 1 is placed on a document table 2 of the ADF 400 with front surfaces of duplex documents included in the document bundle 1 facing upward, as illustrated in FIG. 1. Then, starting with a duplex document at the bottom of the document bundle 1, duplex documents of the document bundle 1 are sequentially picked up and scanned for their document sizes with their front surfaces facing in a direction of the scanning device 221 of the scanning mechanism 220 (illustrated in FIGS. 10A to 10C). Then, each duplex document is reversed so that its front surface faces in a direction of the scanning mechanism 220 (illustrated in FIGS. 10D and 10E). Data of document sizes thus determined is sent from the ADF 400 to the image forming apparatus 200 by a control device (not illustrated) and used for determining a size of a recording medium (later described). This data of document sizes may be also stored as well as scanned document data and used for determining the size of a recording medium used in an image forming operation performed by an external image forming apparatus, such as a printer, based on the scanned data.

Thereafter, the front surface of the duplex document is scanned by the scanning device 221 (illustrated in FIGS. 10F and 10G), and the duplex document is reversed. Then, the back surface of the duplex document is scanned by the scanning device 221 (illustrated in FIGS. 10H to 10J). The duplex document is again reversed and discharged to the stacking mechanism J with the front surface of the duplex document facing upward (illustrated in FIGS. 10K to 10M). At a step illustrated in FIG. 10M, a subsequent duplex document starts being conveyed. When both surfaces of the subsequent duplex document are scanned, the subsequent duplex document is discharged to the stacking mechanism J (shown in FIG. 2) in a similar manner as described above (illustrated in FIGS. 10A to 10M).

In the simplex document scanning mode, the document bundle 1 is placed on the document table 2 of the ADF 400 with front surfaces of the simplex documents of the document bundle 1 facing upward, as illustrated in FIG. 1. Then, starting with a simplex document at the bottom of the document bundle 1, simplex documents of the document bundle 1 are sequentially picked up and scanned for their document sizes with their front surfaces facing in the direction of the scanning mechanism 220 (illustrated in FIGS. 11A to 11C). Then, each simplex document is reversed so that its front surface faces in the direction of the scanning mechanism 220 (illustrated in FIGS. 11D and 11E). Data of the document sizes thus determined is sent from the ADF 400 to the image forming apparatus 200 in a similar manner as in the case of the duplex document scanning mode. This data of document sizes may be also stored as well as scanned document data and used for determining the size of a recording medium used in an image forming operation performed by an external image forming apparatus, such as a printer, based on the scanned data.

Thereafter, the front surface of the simplex document is scanned by the scanning device 221 (illustrated in FIGS. 11F and 11G), and the simplex document is reversed. Then, the simplex document is discharged to the stacking mechanism J with the front surface of the simplex document facing upward (illustrated in FIGS. 11H to 11J). At a step illustrated in FIG. 11J, a subsequent simplex document starts being conveyed. When a surface (i.e., the front surface) of the subsequent simplex document is scanned, the subsequent simplex document is discharged to the stacking mechanism J in a similar manner as described above (illustrated in FIGS. 11A to 11J).

An operation of transferring an image of a document to a recording medium is described for each of the simplex document scanning mode and the duplex document scanning mode.

In the simplex document scanning mode, image data read by the scanning device 221 is written on a surface of the photoconductor 241 by a laser beam emitted from the writing mechanism 230. The recording medium then passes the development mechanism 242, and a toner image is formed on a surface of the recording medium. The recording medium is then conveyed on the sheet-conveying belt 243 at a speed equal to a rotation speed of the photoconductor 241, so that the toner image carried on the photoconductor 241 is transferred to the recording medium. Thereafter, the thus transferred toner image is fixed on the recording medium at the fixing mechanism 244, and the recording medium is discharged by the sheet-discharging mechanism 245 to the finisher 500 which is a post-processing device.

In the finisher 500, the recording medium discharged from the sheet-discharging mechanism 245 of the image forming apparatus 200 is guided either to a direction of the sheet-discharging rollers 501 or to a direction of a stapling mechanism. When the switching plate 502 is moved upward, the recording medium is conveyed by the sheet-conveying roller pairs 503 to be discharged to the regular sheet-discharge tray 504.

Meanwhile, when the switching plate 502 is moved downward, the recording medium is conveyed by the sheet-conveying roller pairs 506 and 507 to be discharged to the stapling table 505. When a recording medium is discharged onto the stapling table 505, an end of the recording medium is aligned by the jogger 508. Then, when a predetermined number of recording mediums (i.e., one set of copies) are discharged, stacked, and aligned on the staple table 505, the recording mediums are stapled by the stapler 509. The predetermined number of recording mediums thus stapled together descend due to their own weights and are stored in the stapled-sheet discharge tray 510.

In FIG. 1, the regular sheet-discharge tray 504 is movable in forward and backward directions (i.e., in directions into and out of the plane of the drawing). The regular sheet-discharge tray 504 moves back and forth after each recording medium or one set of recording mediums sorted out according to image memory is discharged thereon. Thus, the regular sheet-discharge tray 504 performs a simple sorting-out operation of recording mediums discharged thereon.

In the duplex document scanning mode, an image is first formed to one surface of a recording medium conveyed from any one of the sheet-feeding trays 251 to 253, in a similar manner as in the case of the simplex document. However, the recording medium is not guided to the regular sheet-discharge tray 504. Instead, a branching claw (not illustrated) is moved upward to switch paths for conveying the recording medium, so that the recording medium is sent to and stored in the duplex sheet-feeding mechanism 255. Thereafter, the recording medium stored in the duplex sheet-feeding mechanism 255 is again sent out of the duplex sheet-feeding mechanism 255 to transfer a toner image formed on the surface of the photoconductor 241 to the other surface of the recording medium. In this case, the branching claw is moved downward to guide the recording medium to the regular sheet-discharge tray 504.

In this way, the duplex sheet-feeding mechanism 255 is used for forming images on both surfaces of a recording medium.

In transferring images of a duplex document to a recording medium, an image formed on one surface and another image formed on the other surface of the duplex document may be transferred to one surface of a first recording medium and one surface of a second recording medium, respectively. In this case, the image on the front surface of the duplex document is transferred to the first recording medium in a similar manner as in the transferring operation of the simplex document described above. Similarly, the image on the back surface of the duplex document is transferred to the second recording medium. These operations are alternately repeated.

Size of a recording medium is determined based on document size data (later described) sent from the ADF 400 to the image forming apparatus 200 by a control device (not illustrated).

Alternatively, in transferring the images of the duplex document to the recording medium, the image formed on the one surface and the another image formed on the other surface of the duplex document may be transferred to front and back surfaces of one recording medium. In this case, an image formed on the front surface of the duplex document is first transferred to the front surface of the recording medium in a similar manner as in the transferring operation described above. Then, the recording medium is reversed, and an image formed on the back surface of the duplex document is transferred to the back surface of the recording medium. These operations are alternately repeated.

As described above, the size of a recording medium is determined based on the document size data sent from the ADF 400 to the image forming apparatus 200, whether the document is duplex or simplex.

Figure 2:
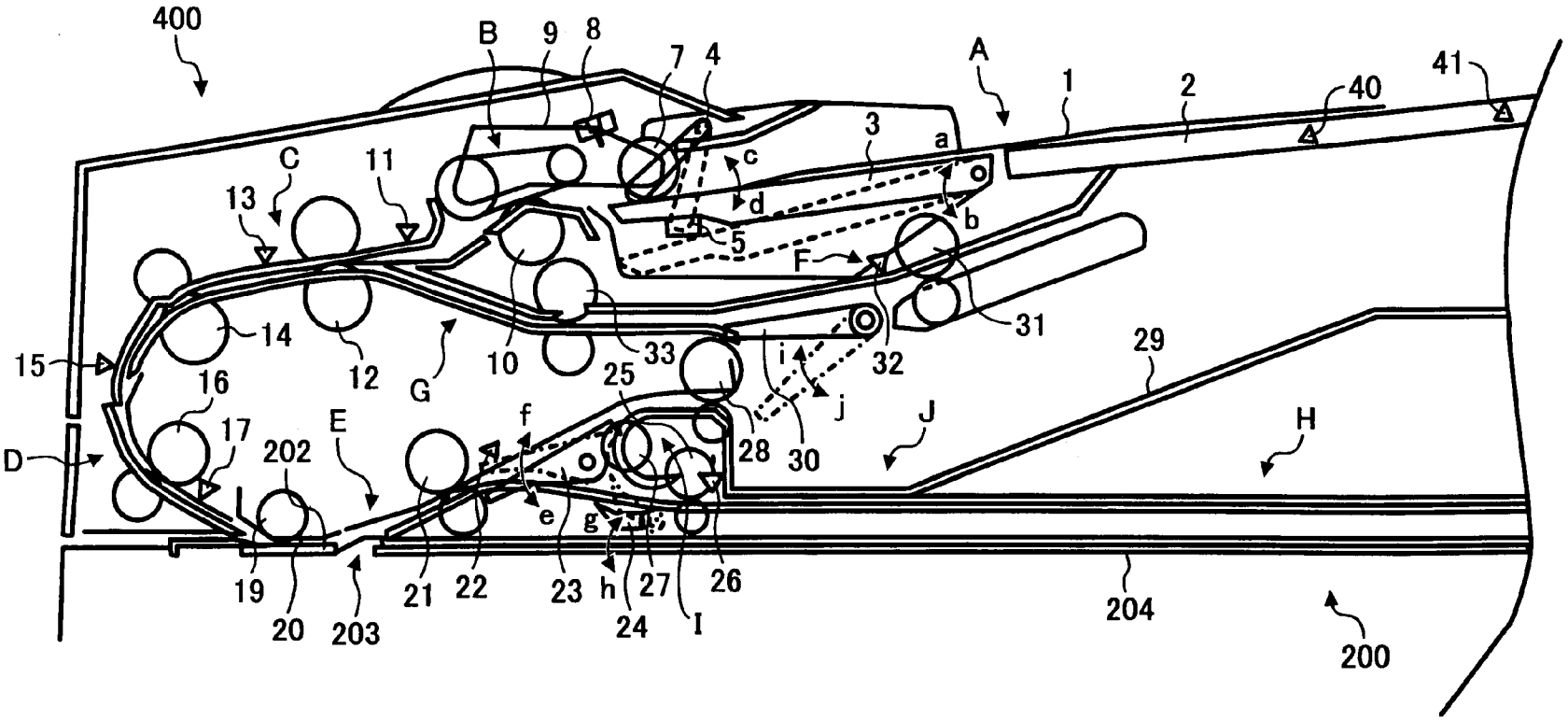
FIG. 2 is a sectional view of an ADF (automatic document feeder) used in the image forming apparatus shown in FIG. 1.
Figure 3:
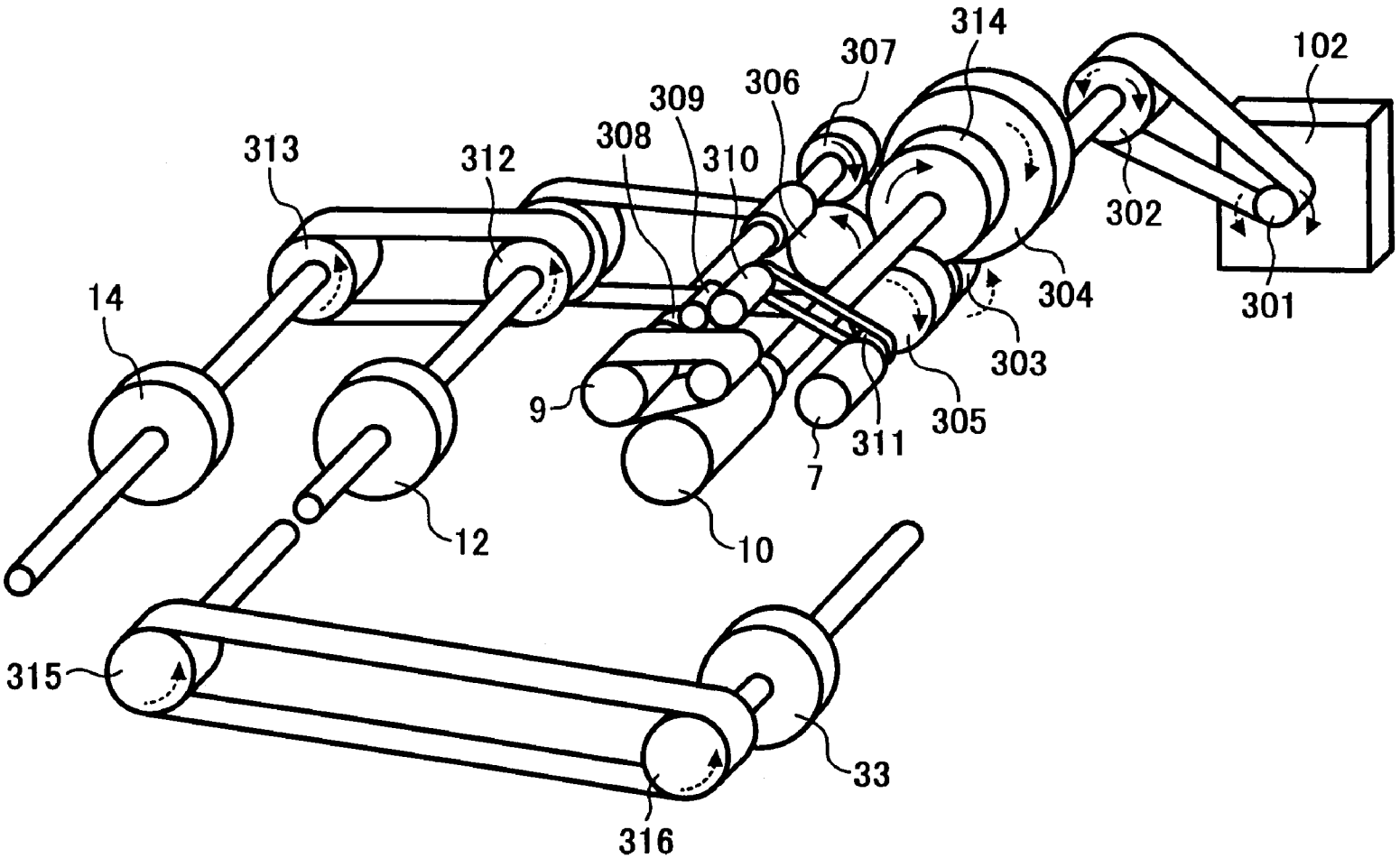
FIG. 3 is a perspective view of a sheet-feeding drive system used in the ADF shown in FIG. 2.
Figure 4:
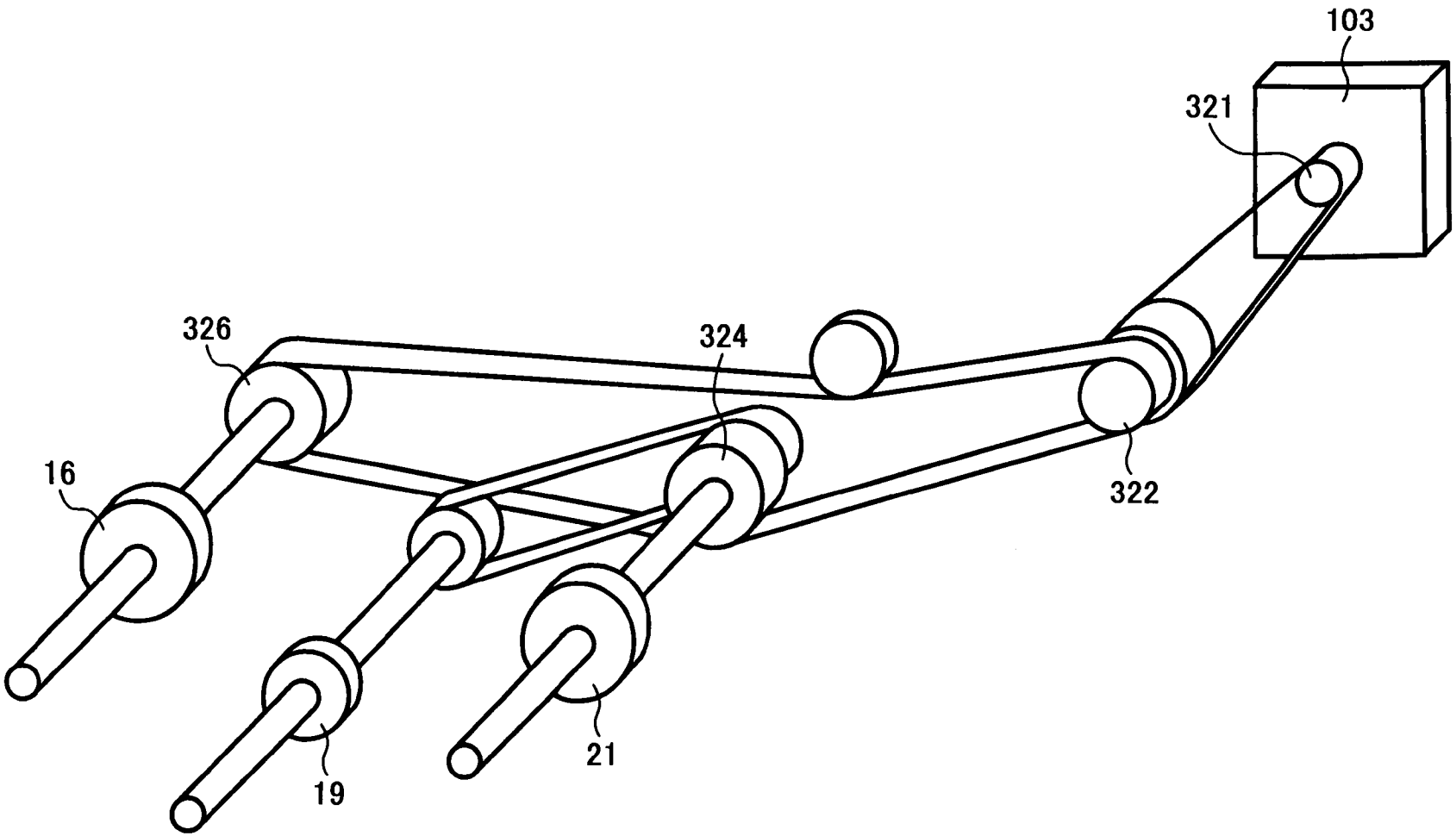
FIG. 4 is a perspective view of a sheet-scanning and conveying drive system used in the ADF shown in FIG. 2.
Figure 5:
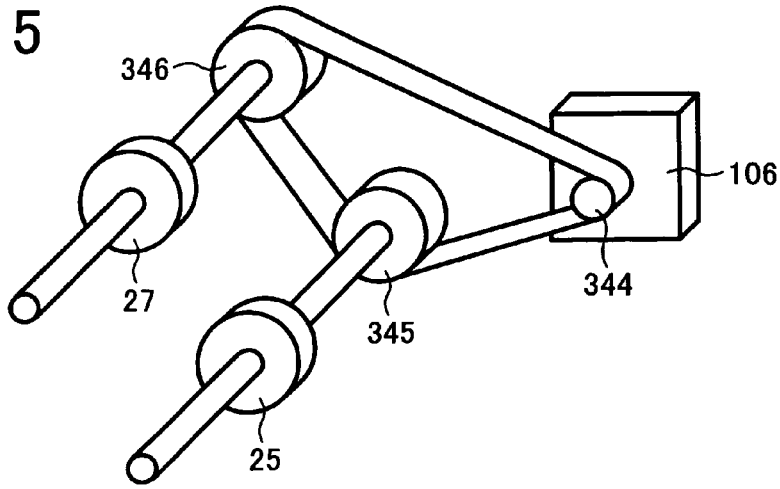
FIG. 5 is a perspective view of a lower reversing mechanism drive system used in the ADF shown in FIG. 2.
Figure 6:
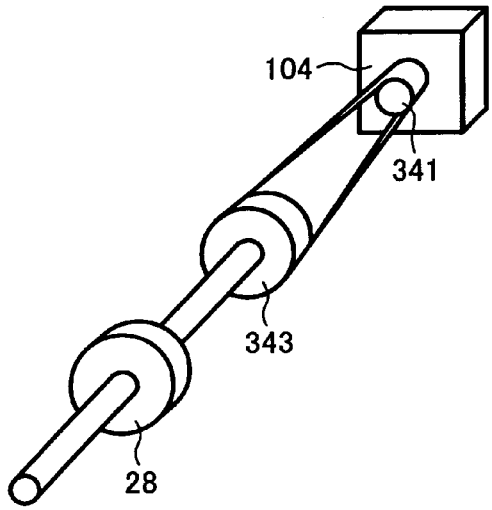
FIG. 6 is a perspective view of a sheet-discharging drive system used in the ADF shown in FIG. 2.
Figure 7:
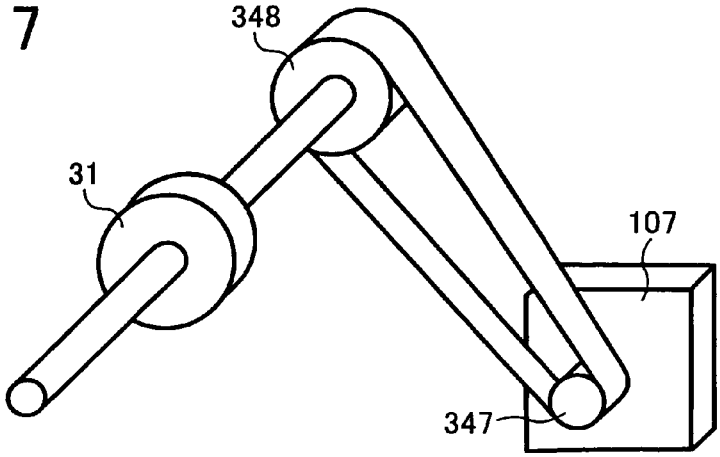
FIG. 7 is a perspective view of an upper reversing mechanism drive system used in the ADF shown in FIG. 2.
Figure 8:
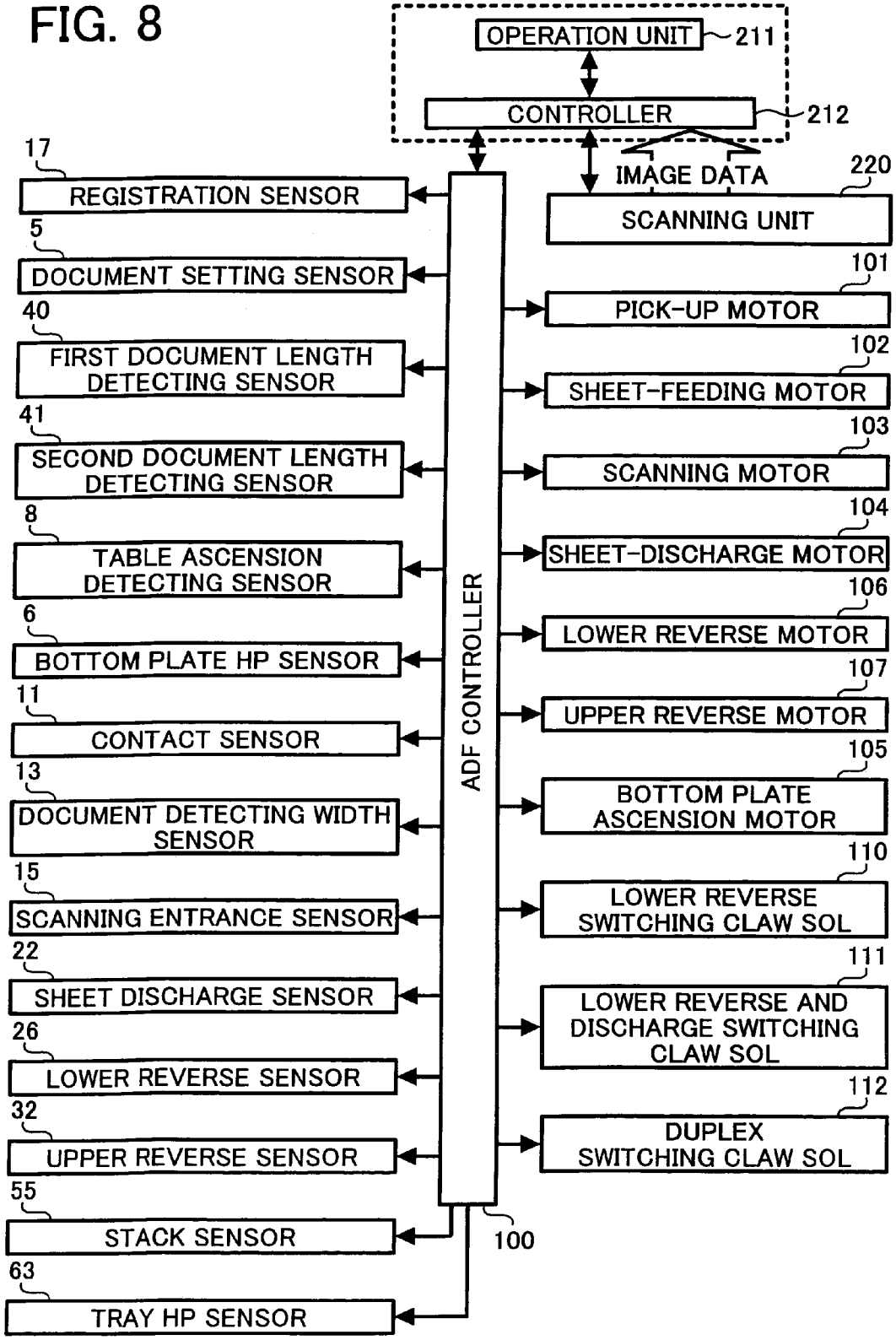
FIG. 8 is a block diagram illustrating electric system of the image forming apparatus shown in FIG. 1.

A configuration and functions of the ADF 400 according to an exemplary embodiment of the present invention are described more in detail with reference to drawings. FIG. 2 illustrates a sectional view of the ADF 400. The ADF 400 includes a document setting mechanism A, a sheet separating and conveying mechanism B, a registration mechanism C, a turn mechanism D, a sheet scanning and conveying mechanism E, an upper reversing mechanism F, an intermediate sheet conveying mechanism G, a lower reversing mechanism H, a sheet reversing and discharging mechanism I, a sheet stacking mechanism J, a plurality of drive systems 101 to 107 (shown in FIG. 8), and an ADF controller 100 (also illustrated in FIG. 8). The sheet separating and conveying mechanism B, the registration mechanism C, and the turn mechanism D form a first conveyance path. The sheet reversing and discharging mechanism I forms a second conveyance path. The lower reversing mechanism H forms a first switchback device, while the upper reversing mechanism F forms a second switchback device.

The ADF 400 further includes the document table 2, a movable document table 3, a document setting filler 4, a document setting sensor 5, a bottom plate HP (home position) sensor 6 (shown in FIG. 8), a pick-up roller 7, a table ascension detecting sensor 8, a sheet-feeding belt 9, a reverse roller 10, a contact sensor 11, a pull-out roller pair 12, document width detecting sensors 13, a turn roller pair 14, a scanning entrance sensor 15, a scanning entrance roller pair 16, a registration sensor 17, a scanning roller 19, a reflecting plate 20, a scanning exit roller pair 21, a sheet-discharge sensor 22, a lower reverse switching claw 23, a lower reverse and discharge switching claw 24, a lower reverse roller pair 25, a lower reverse sensor 26, an auxiliary roller 27, a sheet-discharge roller pair 28, a sheet-discharge tray 29, a duplex switching claw 30, an upper reverse roller pair 31, an upper reverse sensor 32, a relay roller pair 33, and document length detecting sensors 40 and 41.

In the ADF 400, both surfaces of a first duplex document are scanned, and then the first duplex document is conveyed to the upper reversing mechanism F (i.e., second switchback device). While the first duplex document stands by in the upper reversing mechanism F, a second duplex document is conveyed to a scanning position, and a front surface of the second duplex document is scanned. The second duplex document is then conveyed to the lower reversing mechanism H (i.e., first switchback device), and the first duplex document is conveyed from the upper reversing mechanism F, reversed, and discharged to the stacking mechanism J. With this configuration, increase in size and complication in structure of the ADF can be prevented. Further, a speed of a duplex scanning operation can be increased. In addition, the ADF becomes convenient to use.

The ADF 400 is described more in detail with reference to FIGS. 2 to 8.

In FIG. 2, a document bundle 1 is set in the document setting mechanism A. When the duplex document scanning mode is selected, the sheet separating and conveying mechanism B sequentially separates one duplex document from remaining duplex documents in the document bundle 1 and conveys the separated duplex document. The registration mechanism C stops the duplex document, and pulls out and conveys the duplex document at appropriate timing. The turn mechanism D turns and further conveys the duplex document, with a surface of the duplex document to be scanned (i.e., a front surface) facing in a scanning direction (i.e., facing downward). The sheet scanning and conveying mechanism E allows an image formed on the surface of the duplex document to be scanned by the scanning device 221 through the slit glass 202. The upper reversing mechanism F reverses the scanned duplex document. The intermediate sheet conveying mechanism G conveys the duplex document switched back by the upper reversing mechanism F back to the registration mechanism C. After the duplex document is conveyed from the turn mechanism D and a back surface of the duplex document is scanned at the sheet scanning and conveying mechanism E, the duplex document stands by in the lower reversing mechanism H. The reversing and discharging mechanism I reverses the duplex document conveyed from the lower reversing mechanism H and discharges the duplex document to the outside of the ADF 400. The stacking mechanism J stores a plurality of scanned duplex documents in piles. The drive systems 101 to 107 drive members of the above mechanisms to convey documents. The ADF controller 100 controls a series of the operations described above.

In the operation of the ADF 400 described above, the document bundle 1 is set on the document table 2 and the movable document table 3 such that surfaces of the documents to be scanned (i.e., front surfaces) face upward. The document bundle 1 is aligned in a direction perpendicular to a document-conveying direction by side guides (not illustrated).

The document setting filler 4 and the document setting sensor 5 detect that the document bundle 1 has been set. A detection signal indicating the detection is sent to a controller 212 (illustrated in FIG. 7) of the image forming apparatus 200 via an I/F (interface). Any one of the document length detecting sensors 40 and 41, which are a reflective sensor or an actuator-type sensor capable of detecting a single sheet and which are provided in the document table 2, detects an approximate length of documents of the document bundle 1 in the document-conveying direction. The sensors need to be arranged at least to detect a length or a width of the documents.

The movable document table 3 is configured to be driven by a bottom plate ascension motor 105 (illustrated in FIG. 7) to move up and down in directions indicated by arrows "a"

and "b" shown in FIG. 2. When the document setting filler 4 and the document setting sensor 5 detect that the document bundle 1 has been set, the bottom plate ascension motor 105 is driven to rotate in a forward direction. As a result, the movable document table 3 is ascended such that the top surface of the document bundle 1 contacts the pick-up roller 7.

The pick-up roller 7 is driven by a pick-up motor 101 (illustrated in FIG. 7) due to a cam mechanism to move up and down in directions indicated by arrows "c" and "d" in FIG. 2. As the movable document table 3 ascends, the pick-up roller 7 is pressed by the top surface of the document bundle 1 and moves up in the direction of the arrow "c." The upper limit of the movable table 3 is detected by the table ascension detecting sensor 8.

When a print key (not illustrated) of an operation unit 211 (illustrated in FIG. 8) of the image forming apparatus 200 is pressed, and a document feed signal is sent from the controller 212 to the ADF controller 100 (illustrated in FIG. 8) via an I/F, the pick-up roller 7 is driven to rotate along with rotation of the sheet-feeding motor 102 (illustrated in FIG. 3) in the forward direction. Accordingly, the pick-up roller 7 picks up at least one sheet (preferably a single sheet) from the document bundle 1 set on the document table 2.

The pick-up roller 7 rotates in a direction of conveying the top document of the document bundle 1 toward a sheet-feeding direction. The sheet-feeding belt 9 is driven to rotate in the sheet-feeding direction as the sheet-feeding motor 102 rotates in the forward direction. The reverse roller 10 is driven to rotate in an opposite direction to the sheet-feeding direction as the sheet-feeding motor 102 rotates in the forward direction. Accordingly, the reverse roller 10 separates the top document from remaining documents of the document bundle 1 so that only the top document is conveyed.

Specifically, the reverse roller 10 contacts the sheet-feeding belt 9 with predetermined pressure. When the reverse roller 10 is in contact with the sheet-feeding belt 9 with or without a single document placed between them, the reverse roller 10 rotates in a counterclockwise direction in FIG. 1 along with rotation of the sheet-feeding belt 9. If more than one document lies between the reverse roller 10 and the sheet-feeding belt 9, rotation force of the reverse roller 10 is smaller than torque of a torque limiter (not illustrated) attached to the reverse roller 10. Thus, the reverse roller 10 rotates in a clockwise direction which is a forward rotating direction of the reverse roller 10. Accordingly, the reverse roller 10 pushes back unnecessary documents, preventing more than one document from being conveyed at one time.

The document separated from the remaining documents of the document bundle 1 by the sheet-feeding belt 9 and the reverse roller 10 is further conveyed by the sheet-feeding belt 9, and the contact sensor 11 detects a leading end of the document. Then, the document is conveyed to contact the pull-out roller pair 12, which is in a stationary state. Based on a result of detection by the contact sensor 11, the document is conveyed a predetermined distance. The sheet-feeding motor 102 is then stopped, with the document bent at a predetermined angle and pressed against the pull-out roller pair 12. Accordingly, operation of the sheet-feeding belt 9 is stopped.

In this process, the pick-up motor 101 is driven to retract the pick-up roller 7 from the front surface of the document, and the document is conveyed exclusively by conveying force of the sheet-feeding belt 9. Accordingly, the leading end of the document enters into a nip formed between an upper roller and a lower roller of the pull-out roller pair 12, and a front end of the document is aligned, (i.e., skew adjustment). As the sheet-feeding motor 102 rotates in the reverse direction, the pull-out roller pair 12 is driven to perform the skew adjustment and convey the skew-adjusted document to the turn roller pair 14.

When the sheet-feeding motor 102 rotates in the reverse direction, the pull-out roller pair 12 and the turn roller pair 14 are driven, while the pick-up roller 7 and the sheet-feeding belt 9 are not driven. A plurality of the document width detecting sensors 13 are arranged in a direction perpendicular to the plane of FIG. 2 to detect a size of the document in a direction perpendicular to the document-conveying direction.

Meanwhile, a size of the document in the document-conveying direction is calculated based on motor pulses counted after the contact sensor 11 detects a front end of the document until the contact sensor 11 detects a rear end of the document. When the pull-out roller pair 12 and the turn roller pair 14 are driven to convey the document from the registration mechanism C to the turn mechanism D, a speed of conveying the document is increased in the registration mechanism C to be faster than a speed of conveying in the scanning and conveying mechanism E. Accordingly, time required for conveying the document to the scanning and conveying mechanism E is reduced.

When the leading end of the document is detected by the scanning entrance sensor 15, the speed of conveying the document is reduced to approximate a speed of scanning and conveying the document in the scanning and conveying mechanism E. At the same time, a scanning motor 103 (illustrated in FIG. 4) is driven to rotate in the forward rotation direction to drive the scanning entrance roller pair 16, the scanning roller 19, and the scanning entrance roller pair 21. Then, the leading end of the document is conveyed into a nip formed between an upper roller and a lower roller of the scanning entrance roller 16.

When the registration sensor 17 detects the leading end of the document, and when the leading end of the document detected by counting pulses of the scanning motor 103 reaches the scanning device 221, a gate signal indicating an effective image area in a sub-scanning direction formed on a surface of the document to be scanned starts being sent to the controller 212. The gate signal continues to be sent until the rear end of the document passes the scanning device 221. In a simplex document scanning operation, the lower reverse switching claw 23 and the duplex switching claw 30 stay at positions indicated by respective solid lines. After passing the scanning and conveying mechanism E, the document is conveyed to the stacking mechanism J.

If the sheet-discharge sensor 22 detects the leading end of the document while the document is conveyed from the scanning and conveying mechanism E to the stacking mechanism J, a sheet-discharge motor 104 (illustrated in FIG. 6) is rotated in the forward direction to rotate an upper roller of the sheet-discharge roller pair 28 in the counterclockwise direction in FIG. 2. Further, based on counting of pulses of the sheet-discharge motor 104 started after the sheet-discharge sensor 22 detects the rear end of the document, a driving speed of the sheet-discharge motor 104 is reduced immediately before the rear end of the document passes a nip between an upper roller and a lower roller of the sheet-discharge roller pair 28. Accordingly, the document is controlled not to jump out of the sheet-discharge tray 29 when the document is discharged onto the sheet-discharge tray 29.

A prompt document-conveying operation in the simplex document scanning operation is described. When the contact sensor 11 detects the rear end of a simplex document (i.e., first simplex document), and when it is detected based on counting of pulses of the sheet-feeding motor 102 that the rear end of the first simplex document has passed the pull-out roller pair 12, the sheet-feeding motor 102 is stopped and driven to rotate again in the forward direction.

Then, an operation of feeding a subsequent simplex document (i.e., second simplex document) starts. Although operation of the turn roller pair 14 is stopped during the current operation, the turn roller pair 14 is driven to rotate by a one-way clutch (not illustrated) built in a timing pulley 313 (illustrated in FIG. 3). The second document is conveyed and stands by while being pressed against the pull-out roller pair 12. When the first simplex document reaches a predetermined position (i.e., in the vicinity of the scanning entrance roller pair 16 where the rear end of the first simplex document has passed the scanning entrance sensor 15 and pulse counting has started), the sheet-feeding motor 102 is driven to rotate in the reverse direction. Accordingly, the second simplex document is conveyed from the pull-out roller pair 12.

A prompt document-conveying operation in the duplex document scanning operation is then described.

A front surface of a duplex document (i.e., first duplex document) is scanned in a similar manner as in the simplex document scanning operation. However, an operation of conveying a subsequent duplex document (i.e., second duplex document) does not start while the front surface of the first duplex document is scanned. Instead, the second duplex document stays on the document table 2. When the leading end of the first duplex document passes the registration sensor 17, a duplex switching claw SOL (solenoid) 112 (illustrated in FIG. 8) turns on, and the duplex switching claw 30 moves toward a direction of an arrow "j."

Figure 9A:
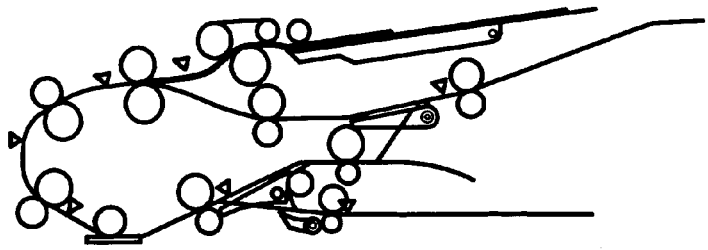
FIGS. 9A to 9J are diagrams illustrating an operation of conveying a plurality of duplex documents performed in the ADF shown in FIG. 2.
Figure 9B:
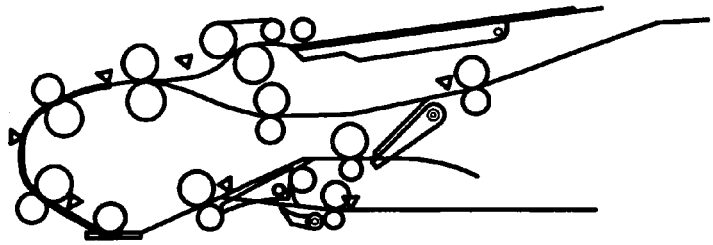
Figure 9C:
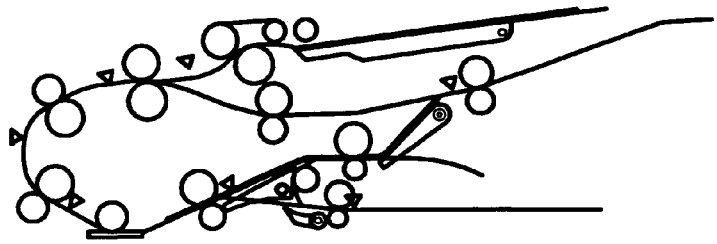

Then, the front surface of the first duplex document is scanned by scanning device 221 in the scanning and conveying mechanism E. Thereafter, the first duplex document is conveyed by the lower reverse switching claw 23 and the sheet-discharge roller pair 28, and is further conveyed on an upper surface of the duplex switching claw 30 to the upper reversing mechanism F (illustrated in FIG. 9C).

When the leading end of the first duplex document passes the sheet-discharge sensor 22, the sheet-discharge motor 104 is driven to rotate in the forward direction. Then, an upper reverse motor 107 (illustrated in FIG. 7) is driven to rotate in the forward direction upon rotation of the upper roller of the sheet-discharge roller pair 28 in the counterclockwise direction in FIG. 1. Accordingly, the upper roller of the upper reverse roller 31 is rotated also in the counterclockwise direction in FIG. 2. When the sheet-discharge sensor 22 detects the rear end of the first duplex document, the sheet-discharge motor 104 and the upper reverse motor 107 are driven at a faster speed than the speed of scanning and conveying a document in the scanning and conveying mechanism E, and operation of the scanning motor 103 is stopped.

When the sheet-discharge sensor 22 detects, based on counting of pulses of the sheet-discharge motor 104, that the rear end of the first duplex document has passed the sheet-discharge roller pair 28, the duplex switching claw SOL 112 is turned off, and the duplex switching claw 30 moves back to its previous position toward a direction of an arrow "i."

Figure 9D:
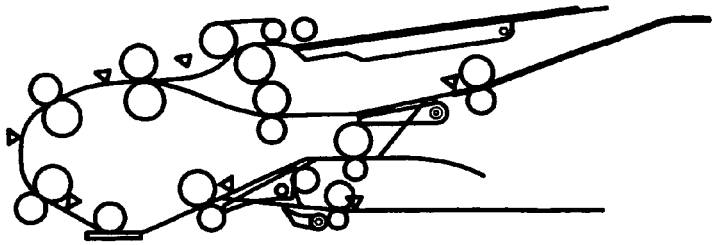

When the upper reverse sensor 32 detects the rear end of the first duplex document, rotation of the upper reverse motor 107 is switched from the forward direction to the reverse direction. Accordingly, rotation of the upper roller of the upper reverse roller pair 31 is switched from the counterclockwise direction to the clockwise direction, and a switchback operation of the first duplex document starts (illustrated in FIG. 9D). Upon the start of the switchback operation, the sheet-feeding motor 102 is driven to rotate in the reverse direction, so that the relay roller pair 33, the pull-out roller pair 12, and the turn roller pair 14 are rotated in a direction of sending back the first duplex document.

Figure 9E:
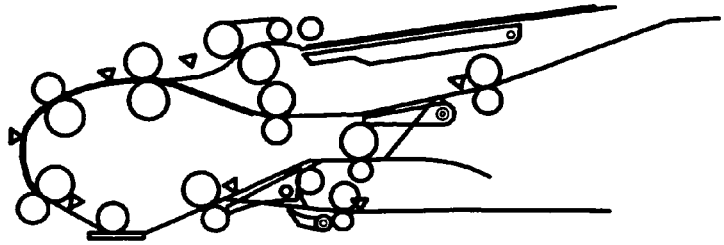

The first duplex document is sent back to the registration mechanism C and the turn mechanism D via the intermediate conveying mechanism G. When the scanning entrance sensor 15 detects the leading end of the first duplex document, pulses of the sheet-feeding motor 102 are counted to a predetermined number, and thereafter the first duplex document is pressed against the scanning entrance roller pair 16 in a stationary state and bent to a predetermined angle. Accordingly, operation of the sheet-feeding motor 102 is stopped, and alignment of the leading end of the first duplex document (i.e., skew adjustment) is performed for a next operation of scanning the back surface of the first duplex document (illustrated in FIG. 9E).

Then, the sheet-feeding motor 102 is again driven to rotate in the reverse direction, and the scanning motor 103 is driven to rotate in the forward direction. Accordingly, the first duplex document is sent to the scanning and conveying mechanism E. When the registration sensor 17 detects the leading end of the first duplex document, a lower reverse switching claw SOL 110 (illustrated in FIG. 8) is turned on, and the lower reverse switching claw 23 moves toward a direction of an arrow "f."

When scanning of the back surface of the first duplex document starts at the scanning device 221 and the sheet-discharge sensor 22 detects the leading end of the first duplex document, a lower reverse motor 106 (illustrated in FIG. 5) is driven to rotate in the forward direction. As a result, the lower reverse roller 25 rotates in the counterclockwise direction, and the first duplex document is conveyed under the lower reverse switching claw 23 and guided to the lower reversing mechanism H.

When the back surface of the first duplex document is scanned and the rear end of the first duplex document is detected by the sheet-discharge sensor 22, the lower reverse switching claw SOL 110 is turned off after pulses of the lower reverse motor 106 are counted to a predetermined number. Accordingly, the lower reverse switching claw 23 moves back to its previous position toward a direction of an arrow "e," and operation of the lower reverse motor 106 is stopped. Accordingly, the first duplex document stands by, with the rear end of the first duplex document held by the lower reverse roller pair 25.

The prompt document-conveying operation in the duplex document scanning operation is described in detail.

When the front surface of the first duplex document is scanned, the first duplex document is conveyed from the upper reversing mechanism F to the intermediate conveying mechanism G. When the upper reverse sensor 32 detects the rear end of the first duplex document, it is detected based on counting of pulses of the sheet-feeding motor 102 that the rear end of the first duplex document has passed the pull-out roller pair 12. Upon this detection, the rotation of the sheet-feeding motor 102 is switched from the reverse direction to the forward direction. Accordingly, conveyance of the second duplex document starts. Operations that follow are performed in a similar manner as in the simplex document scanning operation.

Figure 9F:
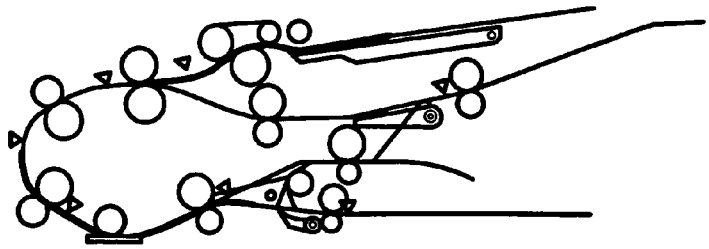
Figure 9G:
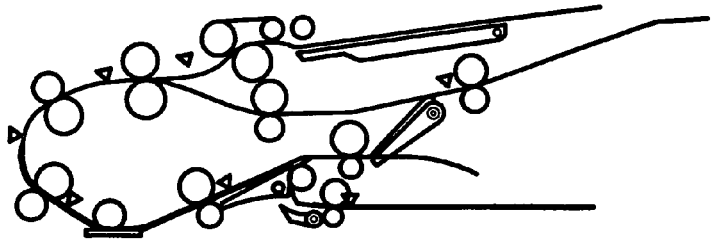
Figure 9H:
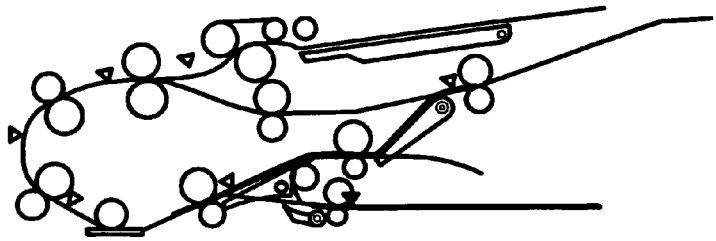
Figure 9I:
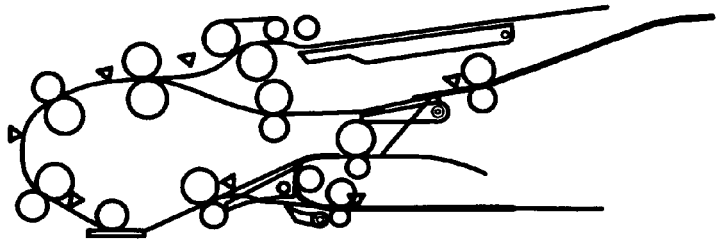

A leading end of the second duplex document is aligned by the pullout roller pair 12 in the registration mechanism C (illustrated in FIG. 9F) and sent to the scanning and conveying mechanism E via the turn mechanism D (illustrated in FIG. 9G). When the registration sensor 17 detects the leading end of the second duplex document, the duplex switching claw 30 moves toward the direction of the arrow "j." Thus, the second duplex document is conveyed by the scanning exit roller pair 21 and further conveyed on the lower reverse switching claw 23, while the front surface of the second duplex document is scanned at the scanning device 221. The second duplex document is then conveyed by the sheet-discharge roller pair 28, and further conveyed on the duplex switching claw 30 to the upper reversing mechanism F. Thereafter, the duplex switching claw 30 moves back to its previous position toward the direction of the arrow "i" (illustrated in FIGS. 9H and 9I).

The back surface of the second duplex document is scanned in a similar manner. The front and back surfaces of the second duplex document are thus scanned in the operations described above, and the second duplex document leaves behind the first duplex document which stands by at the lower reversing mechanism H. When the duplex switching claw 30 returns to its previous position toward the direction of the arrow "i," a lower reverse and discharge switching claw SOL 111 (illustrated in FIG. 8) is turned on, and the lower reverse and discharge switching claw 24 moves in a direction of an arrow "g."

The lower reverse motor 106 is driven to rotate in the reverse direction, so that an upper roller of the lower reverse roller 25 pair and the auxiliary roller 27 are rotated in the clockwise direction. Accordingly, the first duplex document is conveyed from the reversing and discharging mechanism I to the stacking mechanism J. When it is detected based on counting of pulses of the lower reverse motor 106 that the leading end of the first duplex document enters a nip between the upper and lower rollers of the sheet-discharge roller pair 28, the lower reverse switching claw SOL 110 is turned off. Accordingly, the lower reverse and discharge switching claw 24 is returned to its previous position toward a direction of an arrow "h." The auxiliary roller 27 is used for reducing adhesion of a document to an inner guiding plate (not illustrated).

Figure 9J:
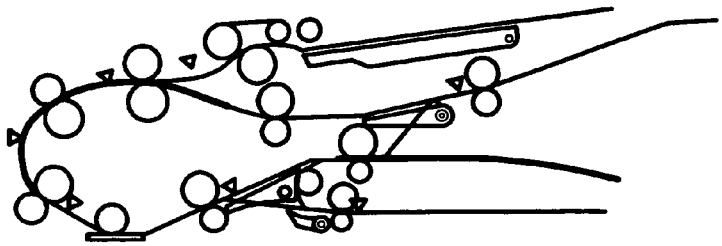

Then, in a similar manner as in the simplex document scanning operation, based on counting of pulses of the sheet-discharge motor 104 started after the lower reverse sensor 26 detects the rear end of the first duplex document, a driving speed of the sheet-discharge motor 104 is reduced immediately before the rear end of the first duplex document passes the nip between the upper and lower rollers of the sheet-discharge roller pair 28. Accordingly, the first duplex document is controlled not to jump out of the sheet-discharge tray 29 when the first duplex document is discharged onto the sheet-discharge tray 29 (illustrated in FIG. 9J).

An example of a sheet conveying operation of the ADF 400 using the lower reversing mechanism H is briefly described with reference to FIGS. 2, 8, and 9A to 9J. When a first duplex document is switched back from the upper reversing mechanism F and the back surface of the first duplex document is scanned, the first duplex document is guided to the lower reversing mechanism H and stacked (illustrated in FIGS. 9D to 9F). A second duplex document is fed in from the document setting mechanism A, with an interval between the first and second duplex documents being reduced (illustrated in FIG. 9F). Then, the front surface of the second duplex document is scanned and guided to the upper reversing mechanism F (illustrated in FIGS. 9G and 9H). When the rear end of the second duplex document thus guided to the upper reversing mechanism F passes the sheet-discharge roller pair 28, and when the duplex switching claw 30 (i.e., an upper reverse branching claw) returns to its previous position toward the direction of the arrow "i," the first duplex document stacked in the lower reversing mechanism H is reversed and discharged (illustrated in FIGS. 9I and 9J).

Another example of the sheet conveying operation of the ADF 400 is then described with reference to FIGS. 2 and 10A to 10M. FIGS. 10A to 10M illustrate an operation of conveying a plurality of duplex documents.

In this operation, to scan duplex documents of different sizes in a mixed-size mode, the size of each duplex document is determined by reversing the duplex document once. As a result, a document size can be determined at a substantially faster speed in the present operation example than in the previous operation example in which the sheet-reversing operation is performed two times by exclusively using the upper reversing mechanism F.

In the present example, to obtain original-size copies of respective differently-sized duplex documents of the document bundle 1 set on the document table 2, a user selects a "duplex document and mixed-size mode" from the operation unit 211.

The size of a duplex document is determined while the duplex document is separated from remaining documents of the document bundle 1 and conveyed. The ADF 400 determines the size of a duplex document by combining ON-information sent from the four document width detecting sensors 13 arranged in a line on the ADF 400 with document length information obtained by counting pulses of motors during a sensor ON-time. The thus obtained document size information is sent from the ADF 400 to the image forming apparatus 200.

In the mixed-size mode, the image forming apparatus 200 needs to select the size of a recording medium. Therefore, accurate document size information is required before a scanning operation of a duplex document starts. When the scanning operation of the front surface of the duplex document starts, however, the rear end of the duplex document does not pass the contact sensor 11 in most cases.

In light of the above, in the previous operation example, the duplex document is circulated in one round without being subjected to the scanning operation so that the size of the duplex document is determined. After the size of the duplex document is determined, a recording medium of an appropriate size is selected. Thereafter, the front surface of the duplex document is scanned in a regular scanning operation.

When the mixed-size mode is selected in the previous operation example, therefore, the document size is determined during a process sequentially illustrated in FIGS. 9A, 9B, 9C, 9D, and 9E (i.e., a first sheet-reversing operation). At a stage illustrated in FIG. 9D, the back surface of the duplex document is prepared for being scanned. Therefore, the duplex document is reversed at a next process sequentially illustrated in FIGS. 9D, 9E, 9C, 9D, and 9E (i.e., a second sheet-reversing operation) to prepare the front surface of the duplex document for being scanned. Thereafter, the front surface of the duplex document is scanned in a process sequentially illustrated in FIGS. 9E, 9F, and 9G. That is, when the mixed-size mode is selected in the previous operation example, the sheet-reversing operation is performed twice before the front surface of the duplex document is scanned, which is time-consuming. Meanwhile, the document size is determined by a single sheet-reversing operation in the present operation example. Accordingly, time required for determining the document size can be reduced.

Figure 10A:
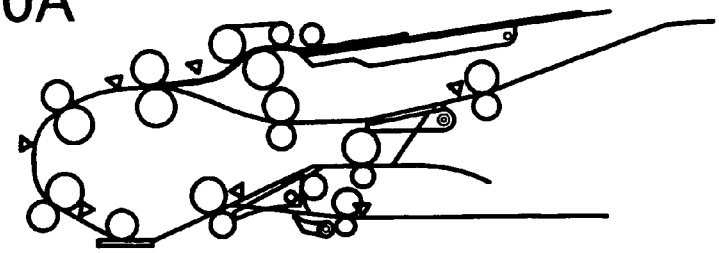
FIGS. 10A to 10M are diagrams illustrating another operation of conveying a plurality of duplex documents performed in the ADF shown in FIG. 2.
Figure 10B:
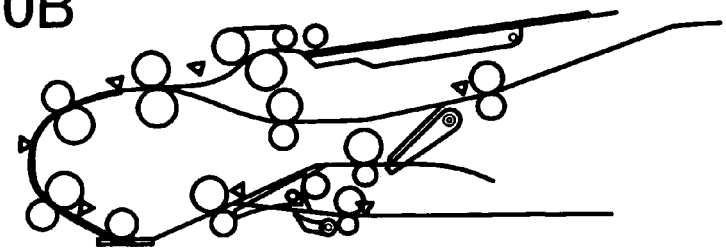
Figure 10C:
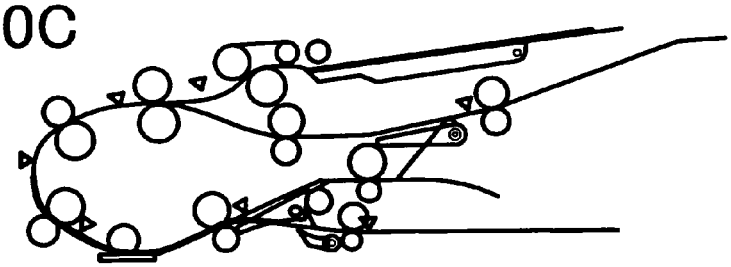
Figure 10D:
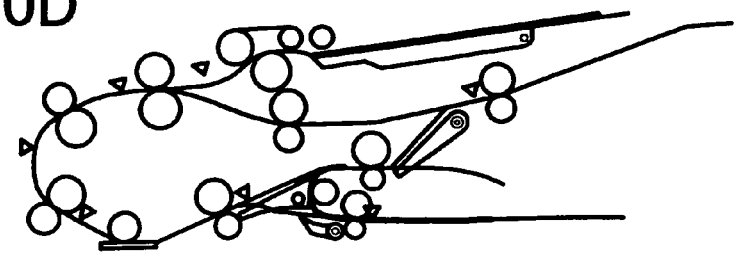
Figure 10E:
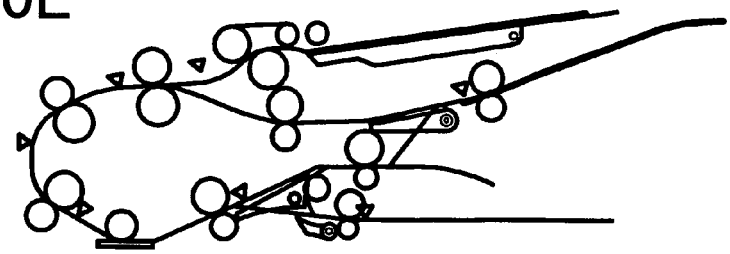

In the present operation example, a duplex document on the top of the document bundle 1 set on the document table 2 is first picked up and separated from remaining duplex documents of the document bundle 1 at the sheet separating and conveying mechanism B (illustrated in FIGS. 10A and 10B). Then, the separated duplex document is conveyed to the scanning and conveying mechanism E. The duplex document is further conveyed to the lower reversing mechanism H without being scanned in the scanning and conveying mechanism E (illustrated in FIG. 10C).

Upon being stored in the lower reversing mechanism H, a switch back operation of the duplex document immediately starts. At the same time, the duplex switching claw SOL 112 is turned on to guide the duplex document to the upper reversing mechanism F, and the duplex switching claw 30 is moved toward the direction of the arrow "j." As a result, the duplex document is stored to the upper reversing mechanism F with its front surface facing in a scanning direction (illustrated in FIGS. 10D and 10E).

Figure 10F:
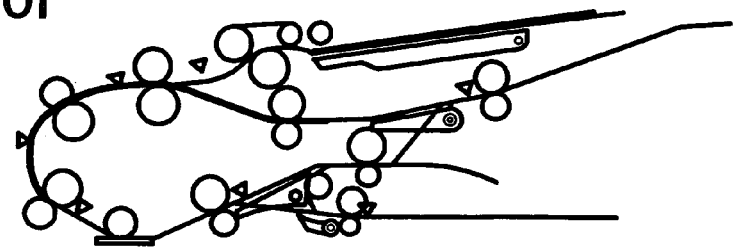
Figure 10G:
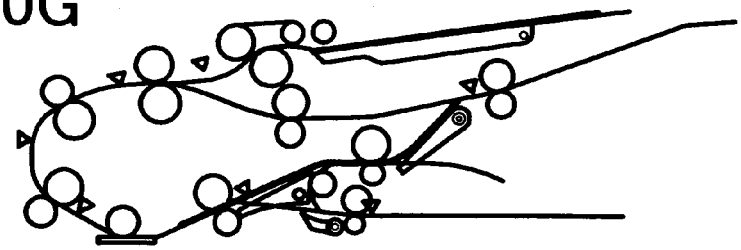
Figure 10H:
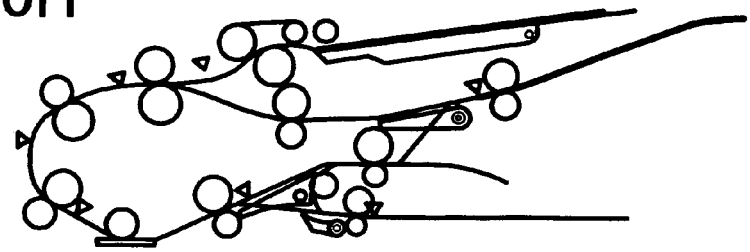

Thereafter, the duplex switching claw 30 is moved back toward the direction of the arrow "i," and the switching-back operation of the duplex document starts so that the front surface of the duplex document is scanned (illustrated in FIG. 10F). The rear end of the duplex document passes the contact sensor 11 until the scanning operation of the front surface of the duplex document completes. Accordingly, information of the length of the duplex document is obtained by pulse counting, and size information of the duplex document is sent from the ADF 400 to the image forming apparatus 200.

After the front surface of the duplex document is scanned, the duplex switching claw 30 is moved again toward the direction of the arrow j, and the duplex document is conveyed to the upper reversing mechanism F. Accordingly, the back surface of the duplex document faces in the scanning direction (illustrated in FIGS. 10G and 10H). Thereafter, the duplex switching claw 30 is moved back toward the direction of the arrow "i," and the switching-back operation of the duplex document starts (illustrated in FIG. 10I). Then, the lower reverse switching claw 23 is moved in the direction of the arrow "f," and the back surface of the duplex document is scanned (illustrated in FIG. 10J). When the duplex document is conveyed to the lower reverse mechanism H and the rear end of the duplex document is detected (illustrated in FIG. 10K), the lower reverse roller pair 25 is immediately driven to rotate in the reverse direction (illustrated in FIG. 10L), and the duplex document is conveyed to the stacking mechanism J (illustrated in FIG. 10M).

In the present operation example, therefore, size determination of a duplex document is carried out by reversing the duplex document once, while the size determination is carried out by reversing the duplex document twice in the previous operation example. Accordingly, time required for determining the document size and for scanning the duplex document can be substantially reduced.

Another example of the sheet conveying operation of the ADF 400 is then described with reference to FIGS. 11A to 11J. FIGS. 11A to 11J illustrate an operation of conveying a plurality of simplex documents. In the present operation example, to scan simplex documents of different sizes in the mixed-size mode, the size of each document is determined in a single sheet-reversing operation, as in the preceding example. As a result, the document size can be determined at a substantially faster speed in the present operation example than in the first operation example in which the sheet-reversing operation is performed two times by exclusively using the upper reversing mechanism F.

In the operation example, to obtain original-size copies of differently-sized simplex documents of the document bundle 1 set on the document table 2, a user selects a "simplex document and mixed-size mode" from the operation unit 211.

When a simplex document scanning mode is selected in the ADF 400, a simplex document is first circulated inside the ADF 400 without being subjected to the scanning operation in a similar manner as in the duplex document scanning mode, so as to determine a size of the simplex document. Thus, a recording medium of an appropriate size is selected upon determination of the document size. Thereafter, the front surface of the simplex document is scanned in a regular scanning operation.

According to the present example, on the other hand, the size of a simplex document is determined by reversing the simplex document once. Thus, the time required for determining the document size can be reduced.

Figure 11A:
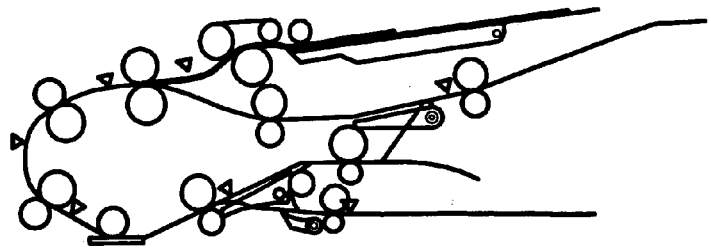
FIGS. 11A to 11J are diagrams illustrating an operation of conveying a plurality of simplex documents performed in the ADF shown in FIG. 2.
Figure 11B:
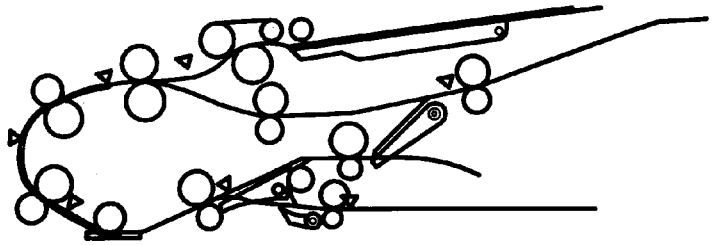
Figure 11C:
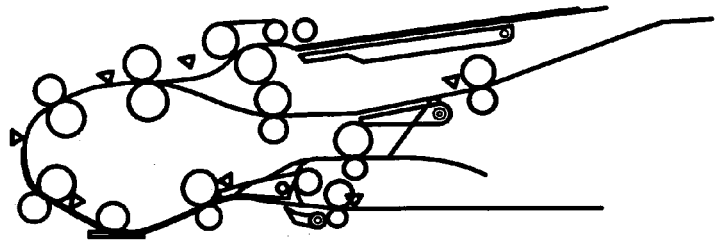
Figure 11D:
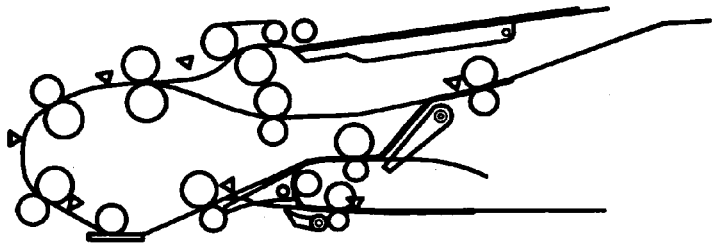
Figure 11E:
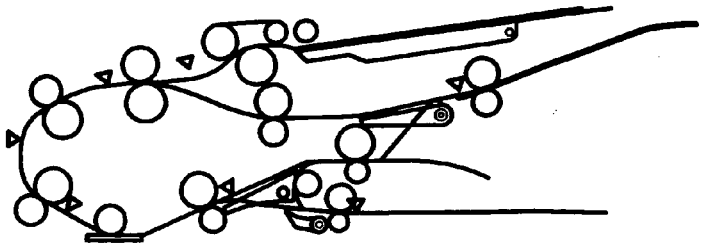

In the present example, a simplex document on the top of the document bundle 1 set on the document table 2 is picked up and separated from remaining documents of the document bundle 1 in the sheet separating and conveying mechanism B (illustrated in FIGS. 11A and 11B). Then, the separated simplex document is conveyed to the scanning and conveying mechanism E. The simplex document is further conveyed to the lower reversing mechanism H without being subjected to the scanning operation (illustrated in FIG. 11C).

The document thus conveyed to and stored in the lower reversing mechanism H is immediately switched back. At the same time, the duplex switching claw SOL 112 is tuned on to guide the simplex document to the upper reversing mechanism F, and the duplex switching claw 30 is moved toward the direction of the arrow "j." Accordingly, the simplex document is conveyed to and stored in the upper reversing mechanism F with the front surface of the simplex document facing in the scanning direction (illustrated in FIGS. 11D and 11E).

Figure 11F:
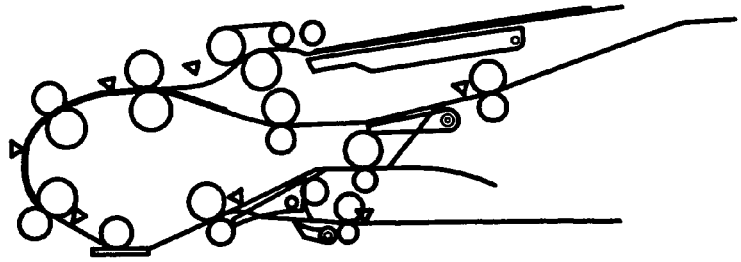

Then, the duplex switching claw 30 is moved back to its previous position toward the direction of the arrow "i," and a switching-back operation of the simplex document starts to have the front surface of the simplex document scanned (illustrated in FIG. 11F). In the present operation, the rear end of the simplex document has passed the contact sensor 11 by the time the scanning operation of the front surface of the simplex document completes. Accordingly, information of the length of the simplex document is obtained based on pulse counting, and the size data of the simplex document is sent from the ADF 400 to the image forming apparatus 200.

Figure 11G:
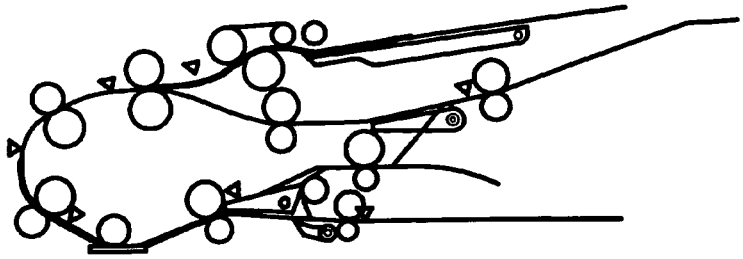
Figure 11H:
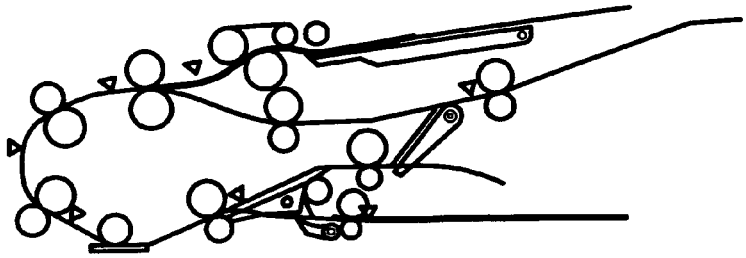
Figure 11I:
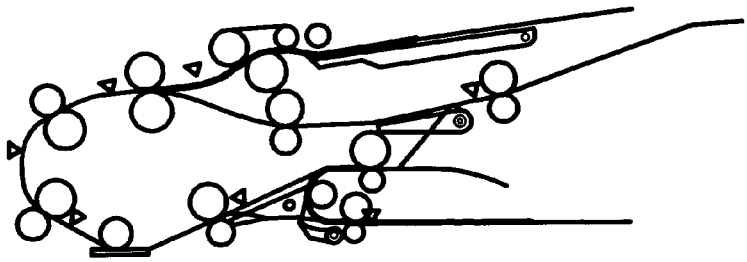
Figure 11J:
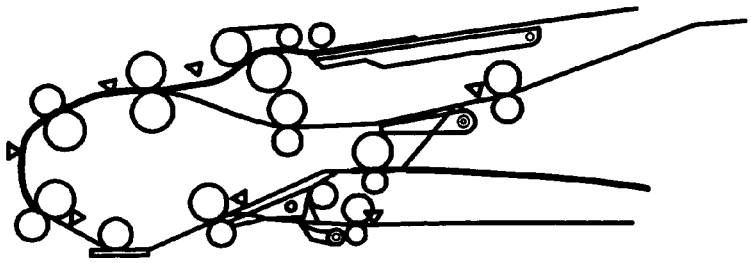

After the front surface of the simplex document is scanned, the lower reverse switching claw 23 is moved toward the direction of the arrow "f." Then, the document is conveyed to the lower reversing mechanism H, and the rear end of the simplex document is detected (illustrated in FIGS. 11G and 11H). Upon detection of the rear end of the simplex document, the lower reverse roller pair 25 is immediately driven to rotate in the reverse direction (illustrated in FIG. 11I), and the document is conveyed to the stacking mechanism J (illustrated in FIG. 11J).

In the present example, therefore, the size of a simplex document is determined by reversing the simplex document once. Accordingly, time required for determining the size of a simplex document and for scanning the simplex document can be substantially reduced.

In the ADF 400, if a scanning operation of the front surface of a duplex document starts while its preceding duplex document of a relatively large size is discharged from the lower reversing mechanism H, a rotation direction of rollers for receiving the duplex document contradicts a rotation direction of rollers for discharging the preceding duplex document. This contradiction in direction can be avoided by delaying the start of the scanning operation of the second duplex document. However, time required for the document-conveying operation is increased. In an ADF according to another exemplary embodiment of the present invention, the duplex document of a relatively large size can be conveyed in a relatively short time.

Figure 12:
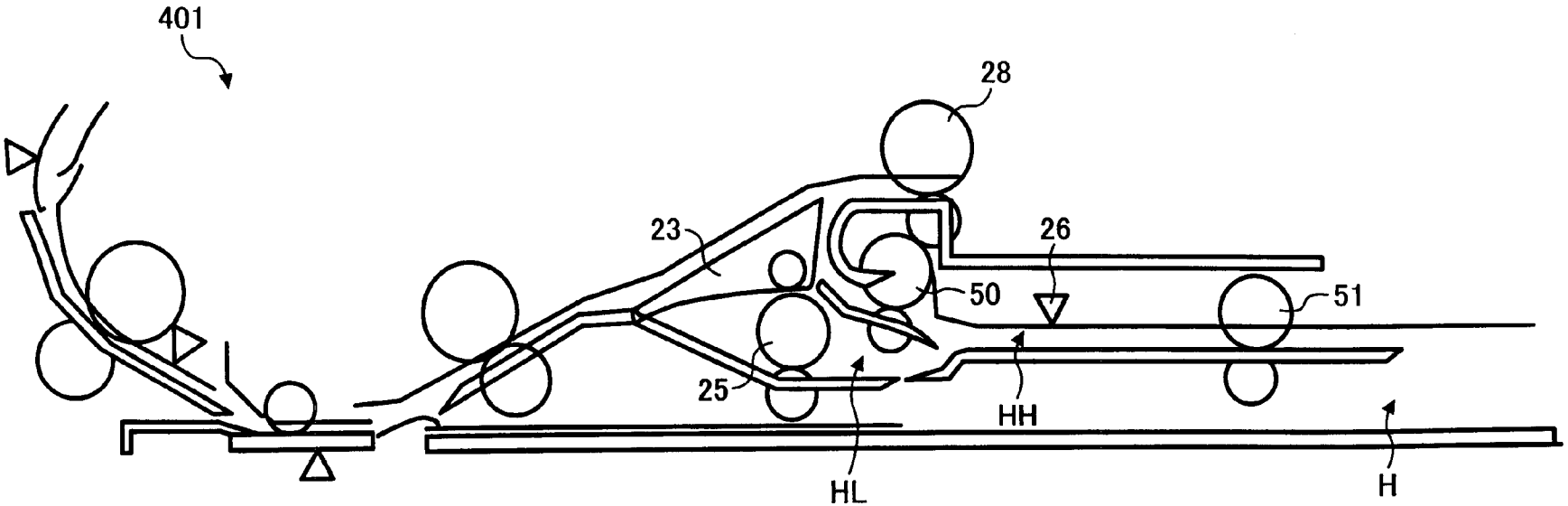
FIG. 12 is a side sectional view of related parts of an ADF according to another exemplary embodiment of the present invention.

The ADF 401 according to another exemplary embodiment of the present invention is described with reference to FIGS. 2 and 12. FIG. 12 illustrates a side sectional view of the lower reversing mechanism H of the ADF 401. In FIG. 12, the ADF 401 includes a lower reverse discharging roller pair 50, a lower reverse receiving roller pair 51, a lower reverse discharging mechanism HH, and a lower reverse receiving mechanism HL. Description is omitted for other components (not illustrated in FIG. 12) of the ADF 401 which are similar to components of the ADF 400 illustrated in FIG. 2. Instead, differences between the ADF 400 and the ADF 401 are described.

In the ADF 401 illustrated in FIG. 12, due to the lower reverse roller pair 25 which receives a duplex document conveyed from the scanning position in the scanning and conveying mechanism E and the lower reverse receiving roller pair 51 which is located at a downstream position of the lower reverse roller pair 25, a second duplex document can be received by the lower reversing mechanism H while a first duplex document is discharged from the lower reversing mechanism H.

Figure 13:
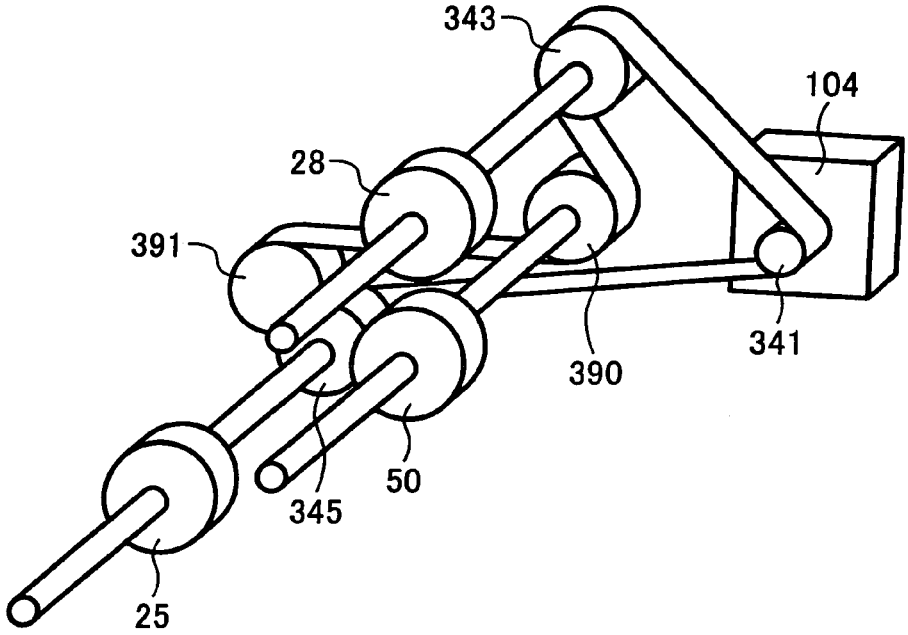
FIG. 13 is a perspective view of a lower reversing mechanism drive system used in the ADF shown in FIG. 12.

FIG. 13 illustrates a perspective view of a sheet-discharging drive system used in the ADF 401 shown in FIG. 12. When the sheet-discharge motor 104 rotates, driving force of the sheet-discharge motor 104 is sequentially transmitted to the pulley 341, a pulley 391, a pulley 390, and the pulley 343, so that the lower reverse roller pair 25, the sheet-discharge roller pair 28, and the lower reverse discharging roller pair 50 rotate. The pulley 390 is applied with tension pressure by a spring or the like to be driven. The pulley 391 has a gear and engages with the pulley 345 having a gear to rotate the lower reverse roller pair 25 in a direction opposite to a rotation direction of the sheet-discharge roller pair 28 and the lower reverse discharging roller pair 50. That is, due to operation of the sheet-discharge motor 104 and a one-way clutch mechanism, the lower reverse discharging roller pair 50 and the sheet-discharge roller pair 28 rotate in the forward direction, while the lower reverse roller pair 25 rotates in the reverse direction in response to the rotation of the sheet-discharge motor 104 in the forward direction.

Figure 14:
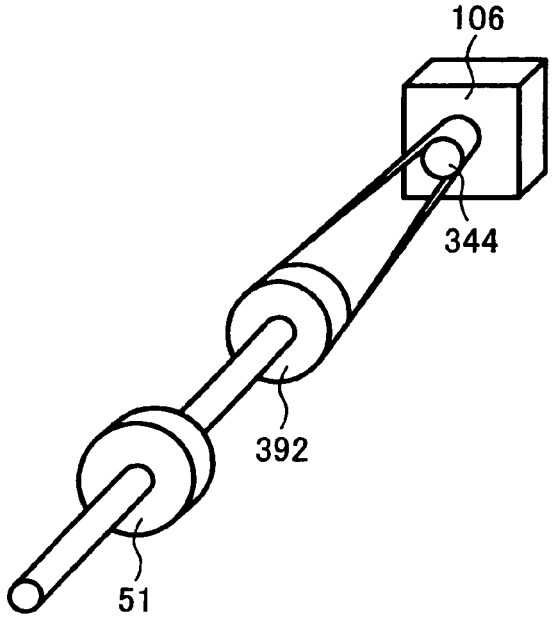
FIG. 14 is a perspective view of a sheet-discharging drive system used in the ADF shown in FIG. 12.

FIG. 14 illustrates a perspective view of a lower reversing mechanism drive system used in the ADF 401 shown in FIG. 12. When the lower reverse motor 106 rotates, drive force of the lower reverse motor 106 is transmitted to the pulley 344 and a pulley 392, so that the lower reverse receiving roller pair 51 rotates. Accordingly, the lower reverse receiving roller pair 51 can rotate in both forward and reverse directions.

Figure 15A:
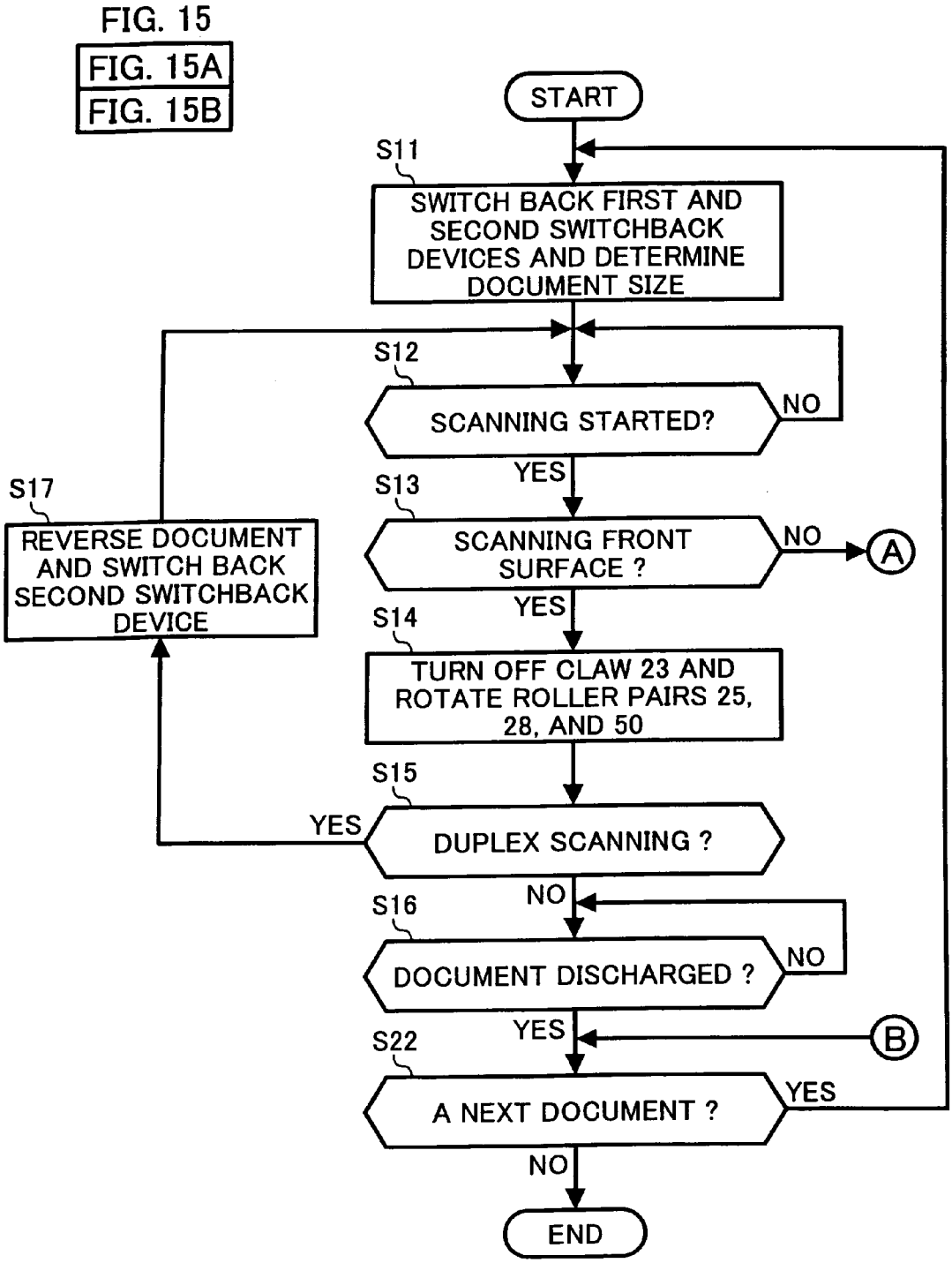
FIGS. 15A and 15B are a flowchart illustrating operations of members of a lower reversing mechanism in the ADF shown in FIG. 12.
Figure 15B:
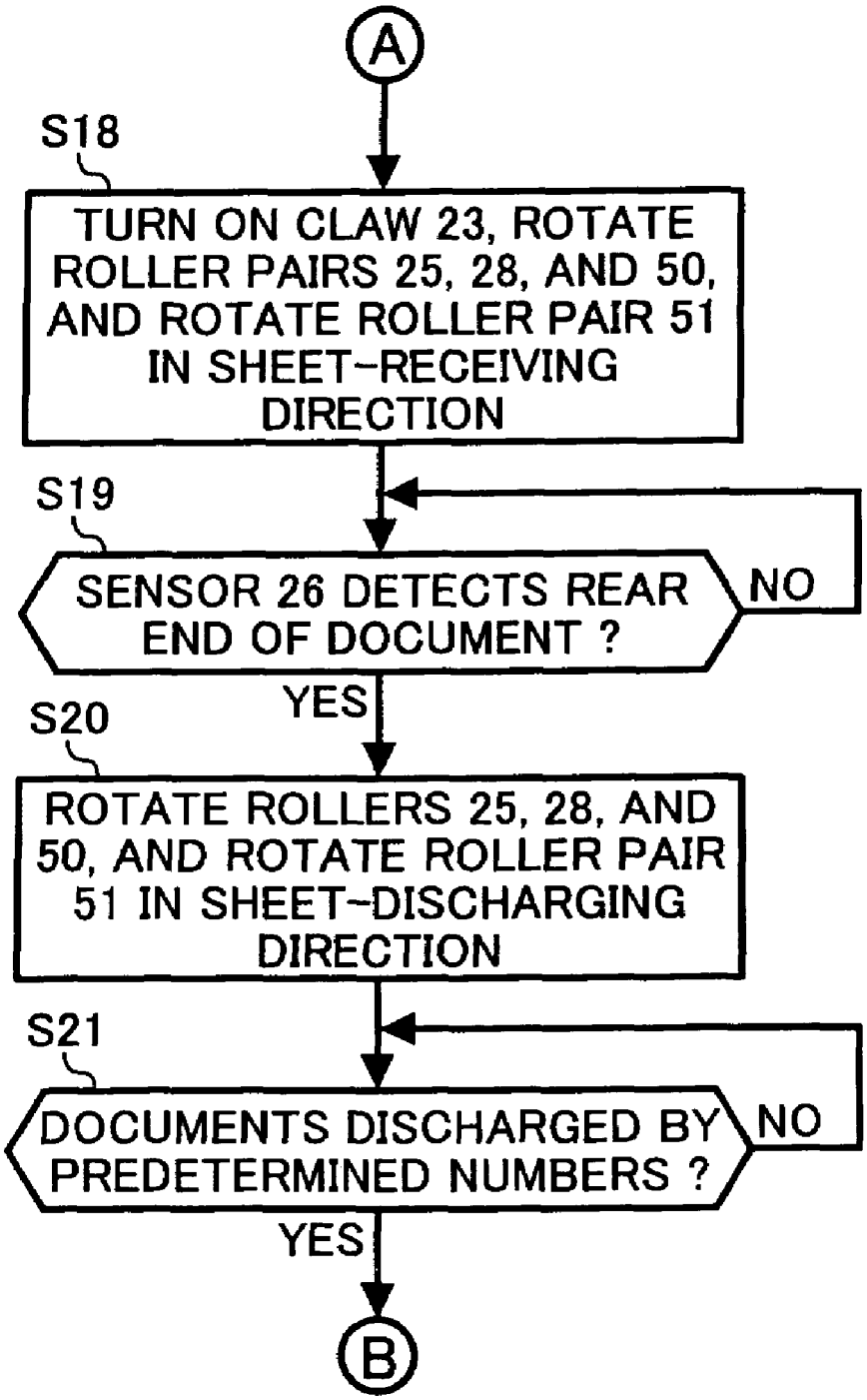

Operation of each of members forming the lower reversing mechanism H is described with reference to a flowchart of FIGS. 15A and 15B as well as FIGS. 10A to 10M, 11A to 11J, and 12.

At Step S11, the document bundle 1 including documents of different sizes is set on the document table 2. To obtain original-size copies of the differently-sized documents (i.e., the mixed-size mode), a document on the top of the document bundle 1 set on the document table 2 is picked up and separated from remaining documents of the document bundle 1 in the sheet separating and conveying mechanism B. The separated document is then conveyed to the turn mechanism D and the scanning and conveying mechanism E. When the lower reverse switching claw 23 is on (i.e., when the lower reverse switching claw 23 is raised in FIG. 12) and the lower reverse roller pair 25 and the lower reverse receiving roller pair 51 rotate in the same direction, the document is conveyed through the lower reverse receiving mechanism HL and received by the lower reversing mechanism H (i.e., the first switchback device). When the rear end of the document passes the lower reverse roller pair 25, the lower reverse receiving roller pair 51 starts rotating in the reverse direction. As a result, the document is switched back and conveyed in a direction of discharging the document from the lower reversing mechanism H and conveyed through the lower reverse discharging mechanism HH. The document is further conveyed by the lower reverse discharging roller pair 50 and the sheet-discharge roller pair 28, and conveyed on the duplex switching claw 30 which is moved toward the direction of the arrow "j." Accordingly, the document is sent to and stored in the upper reversing mechanism F (i.e., the second switchback device) with the front surface of the document facing in the scanning direction (illustrated in FIGS. 10A to 10E or 11A to 11E). The document is then switched back to be sent out of the upper reversing mechanism F, and is conveyed to the turn mechanism D and the scanning and conveying mechanism E. In this operation of conveying the document, the size of the document is determined according to the procedure of either one of the previous embodiments described above.

Then, the document is scanned by the scanning device 221 (YES in Step S12) (illustrated in FIG. 9F or 10F).

When the front surface of the document is scanned (YES in Step S13), the lower reverse switching claw 23 (i.e., a separation claw) is turned off (i.e., the lower reverse switching claw 23 is lowered in FIG. 11), and the lower reverse roller pair 25, the sheet-discharge roller pair 28, and the lower reverse discharging roller pair 50 rotate (Step S14).

If the duplex document scanning mode is not selected, i.e., the simplex document scanning mode is selected (NO in Step S15), the document is conveyed under the duplex switching claw 30, which is moved toward the direction of the arrow "i," and is sent to the stacking mechanism J (YES in Step S16).

If the duplex document scanning mode is selected (YES in Step S15), the document is conveyed by the sheet-discharge roller pair 28 and further conveyed on the duplex switching claw 30, which is moved toward the direction of the arrow "j." Then, the document is sent to the upper reversing mechanism F with the back surface of the document facing in the scanning direction. The document is then switched back and sent out of the upper reversing mechanism F (Step S17) (illustrated in FIGS. 10G and 10H).

Figure 10I:
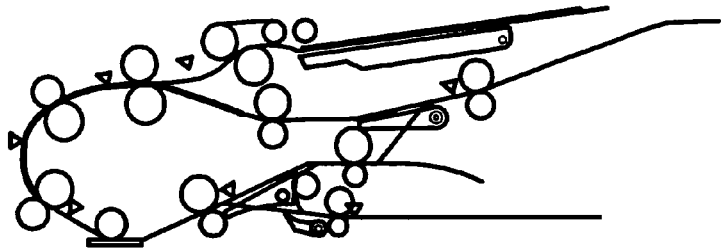
Figure 10J:
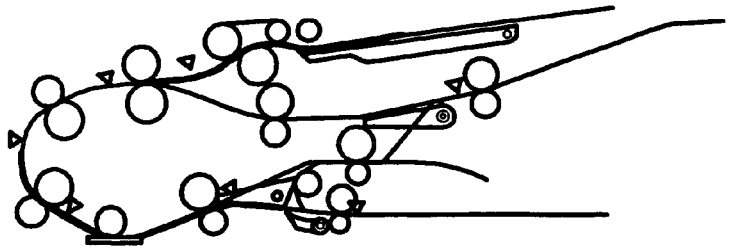
Figure 10K:
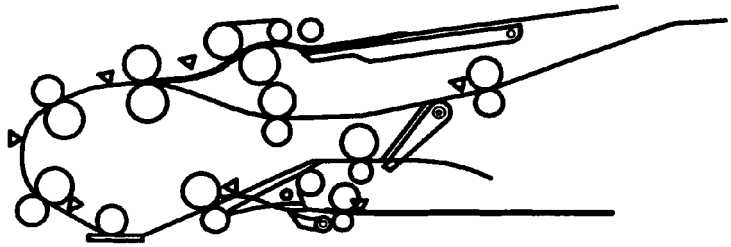
Figure 10L:
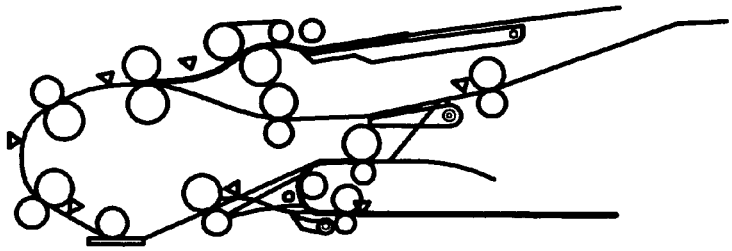
Figure 10M:
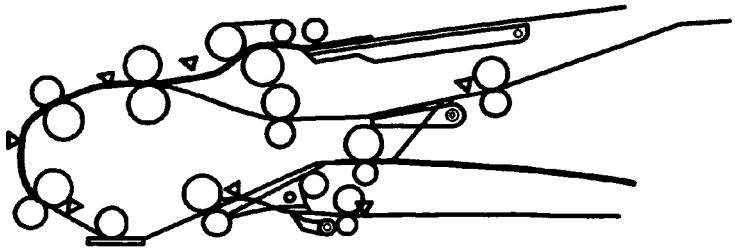

When the front surface of the document is not scanned, i.e., when the back surface of the document is scanned (NO in Step S13), the document is conveyed to the turn mechanism D and the scanning and conveying mechanism E and scanned by the scanning device 221 (Step S18) (illustrated in FIGS. 10I and 10J). Since the back surface of the document is scanned in this case, the lower reverse switching claw 23 is turned on (i.e., the lower reverse switching claw 23 is raised in FIG. 12), and the lower reverse roller pair 25, the lower reverse receiving roller pair 51, the sheet-discharge roller pair 28, and the lower reverse discharging roller pair 50 rotate. The lower reverse roller pair 25 and the lower reverse receiving roller pair 51 rotate in the same direction so that the document is received in the lower reversing mechanism H. Accordingly, the document is conveyed through the lower reverse receiving mechanism HL and sent to the lower reversing mechanism H (illustrated in FIG. 10K).

When the lower reverse sensor 26 detects the rear end of the document (YES in Step S19), the lower reverse receiving roller pair 51 starts rotating in the reverse direction to discharge the document from the lower reversing mechanism H, and the lower reverse roller pair 25, the lower reverse receiving roller pair 51, the sheet-discharge roller pair 28, and the lower reverse discharging roller pair 50 rotate, respectively (Step S20). Accordingly, the document is conveyed in the direction of discharging the document from the lower reversing mechanism H. The lower reversing mechanism H is configured to guide the leading end of the document toward the lower reverse discharging roller pair 50 in conveying the document in the direction of discharging the document. Therefore, the document is conveyed through the lower reverse discharging mechanism HH and further conveyed by the lower reverse discharging roller pair 50 and the sheet-discharge roller pair 28. The document is further conveyed under the duplex switching claw 30, which is moved toward the direction of the arrow "i," and is sent to the stacking mechanism J (illustrated in FIGS. 10L and 10M).

The Step S20 continues until a predetermined number of copies are output according to a size of each document (Step S21).

In the duplex document and mixed-size mode, it is now assumed that, when a first duplex document is at the stage illustrated in FIG. 10J, a second duplex document at the stage illustrated in FIG. 10A starts being conveyed. After the first duplex document is received in the lower reversing mechanism H (i.e., Step S18 illustrated in FIG. 10K), the first duplex document is conveyed from the lower reversing mechanism H in the direction of discharging the first duplex document from the lower reversing mechanism H and sent to the stacking mechanism J (illustrated in FIG. 10L). If the first duplex document is a relatively large size such as A3, for example, a length of the first duplex document is relatively large. Therefore, detection of the size of the second duplex document may start and the second duplex document may be conveyed to the lower reversing mechanism H while the first duplex document is discharged from the lower reversing mechanism H (illustrated in FIG. 10C). The present embodiment solves this problem.

In the present embodiment, discharging of the first duplex document and receiving of the second duplex document in the lower reversing mechanism H are performed as follows.

The first duplex document is conveyed from the lower reversing mechanism H by the lower reverse receiving roller pair 51, which now rotates in the direction of discharging the first duplex document from the lower reversing mechanism H, i.e., a direction reverse to the rotation direction of the lower reverse roller pair 25, through the lower reverse discharging mechanism HH in the document-discharging direction. During this time, the second duplex document is conveyed by the lower reverse roller pair 25 through the lower reverse receiving mechanism HL and sent to the lower reversing mechanism H, while the first duplex document is conveyed above the second duplex document through the lower reverse discharging mechanism HH.

When the lower reverse sensor 26 detects the rear end of the first duplex document, the lower reverse receiving roller pair 51 starts rotating in the reverse direction, so that the lower reverse receiving roller pair 51 and the lower reverse roller pair 25 rotate in the same direction to receive the second duplex document.

When the leading end of the second duplex document reaches the lower reverse receiving roller pair 51, the second duplex document is conveyed by the lower reverse roller pair 25 and the lower reverse receiving roller pair 51 to the lower reversing mechanism H.

In this way, the lower reverse roller pair 25 is driven to rotate in the direction of receiving the second duplex document, while the lower reverse receiving roller pair 51 is driven to rotate in the document-discharging direction. Accordingly, the first and second duplex documents can be conveyed within the lower reversing mechanism H without contacting with each other.

Figure 16:
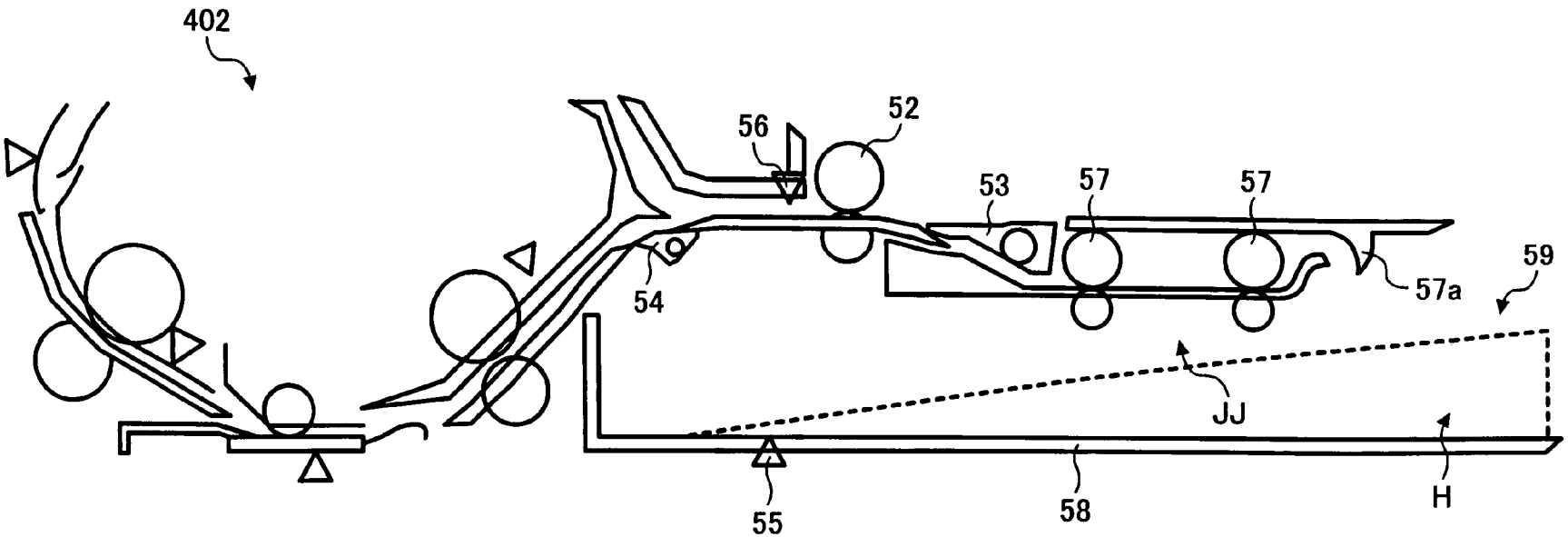
FIG. 16 is a side sectional view of related parts of an ADF according to another exemplary embodiment of the present invention.

An ADF according to another embodiment of the present invention is described with reference to FIGS. 2 and 16. FIG. 16 illustrates a side sectional view of the lower reversing mechanism H of the ADF 402. In FIG. 16, the ADF 402 includes a reverse roller pair 52, a reverse branching claw 53, a discharge branching claw 54, a reverse sensor 56, a reverse protrusion 57*a*, stack receiving roller pairs 57, and a discharge tray 58. JJ indicates a stacking mechanism. Description is omitted for other components (not illustrated in FIG. 16) of the ADF 402 which are similar to components of the ADF 400 illustrated in FIG. 2. Instead, differences between the ADF 400 and the ADF 402 are described.

In the ADF 402 illustrated FIG. 16, the upper reversing mechanism F is not used, and the lower reversing mechanism H is exclusively used. In the simplex document scanning mode, the discharge branching claw 54 is moved to guide a simplex document to the stacking mechanism JJ with the front surface of the simplex document facing downward.

In the duplex document scanning mode, the front surface of a duplex document is first scanned, and then the duplex document is conveyed toward the lower reversing mechanism H. When the reverse sensor 56 detects the rear end of the duplex document, the rotation of the reverse roller pair 52 is switched from the forward direction to the reverse direction. Accordingly, the duplex document is switched back and sent back into the ADF 402 so that the back surface of the duplex document is scanned.

The reverse roller pair 52 is driven to rotate either in the forward direction or in the reverse direction by an upper reversing motor (not illustrated). The sheet-discharge motor 104 exclusively drives to rotate the stack receiving roller pairs 57 in the forward direction. To scan the back surface of the duplex document, the scanning motor 103 (not illustrated), the upper reverse motor 107, and the sheet-discharge motor 104 are respectively driven to rotate in the direction of conveying the duplex document.

At the same time, the reverse branching claw 53 is placed in a movable state, and the duplex document is guided to the stacking mechanism JJ. After the reverse sensor 56 detects the rear end of the duplex document, the duplex document is conveyed by a predetermined distance. Then, the reverse branching claw 53 returns to its previous position to be prepared for receiving a subsequent duplex document.

The duplex document is conveyed by the stack receiving roller pairs 57 with the front surface of the duplex document facing upward. Therefore, if the duplex document is directly conveyed to the stacking mechanism JJ, the duplex document is discharged upside down. This causes a user trouble. To solve this problem, the reverse protrusion 57*a* is provided at a downstream position of the stack receiving roller pairs 57 to reverse and stack the duplex document on the stacking mechanism JJ with the front surface of the duplex document facing downward.

In the ADF 402 illustrated FIG. 16, the discharge tray 58 may be replaced by a discharge tray 59. With this configuration, simplex documents discharged by the discharge branching claw 54 and duplex documents discharged by the reverse branching claw 53 are stacked along the slope on the discharge tray 59. As a result, the documents are stacked in an appropriate order with ends of the documents aligned.

Further, in the ADF 402, a stack sensor 55 may be provided at a lower position of the discharge tray 59, as illustrated in FIG. 16. A discharged document is stacked along the slope of the discharge tray 59. With the stack sensor 55 provided in vicinity of a foot of the slope, therefore, presence or absence of a document on the discharge tray 59 can be detected based on output or no-output from the stack sensor 55.

Figure 17:
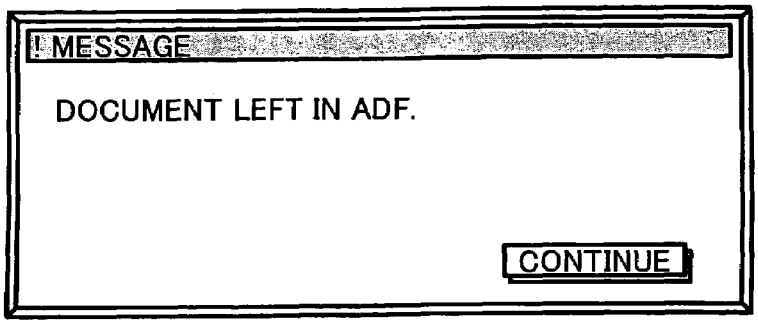
FIG. 17 is a diagram illustrating a display on a touch panel screen of the ADF shown in FIG. 16.

When a copying operation (i.e., copy job) is completed and all of documents are discharged, a warning message as illustrated in FIG. 17 may be displayed on a touch panel screen of the operation unit 211. Upon removal of all of the documents (i.e., when the output from the stack sensor 55 is turned off), communication with the image forming apparatus is established and the warning message is erased. With this configuration, the presence or absence of a document discharged and left in the ADF 402 can be immediately determined. As a result, a user may not forget to collect discharged documents. Further, the user is freed from a need to sort out the discharged documents.

Furthermore, a "continue" button may be displayed on the touch panel screen of the operation unit 211, as illustrated in FIG. 17. With this configuration, even if a discharged document is left in a discharge tray, a user can continue the copy job by touching the "continue" button. That is, when the warning message is displayed, the present embodiment allows the user to opt for continuing a document scanning operation.

Thus configured, time necessary for reversing and discharging a document is saved, and thus the productivity in the duplex document scanning operation can be increased. Further, when a document needs to be urgently copied, for example, the user can immediately set the document on the ADF to copy the document, whether or not any document is left in the ADF.

Figure 18:
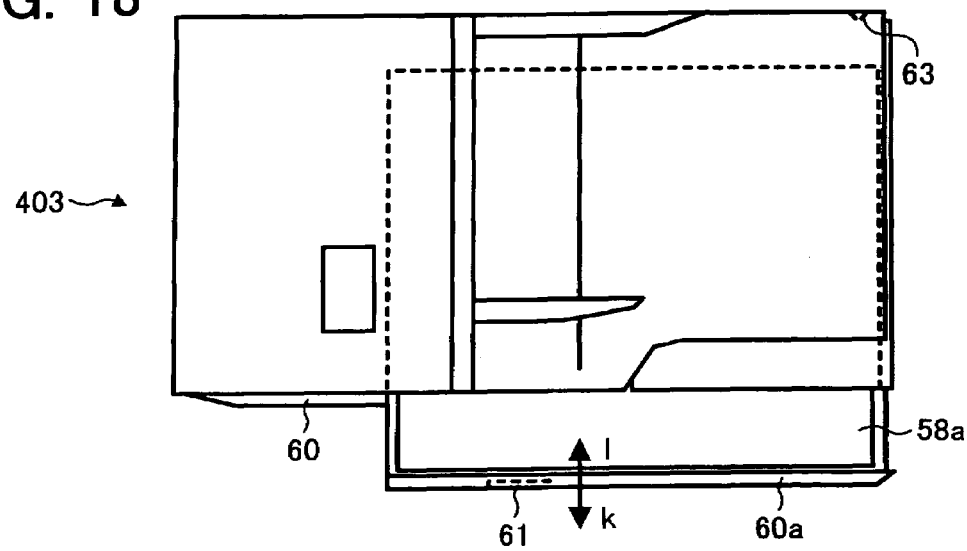
FIG. 18 is a diagram illustrating another display on the touch panel screen of the ADF shown in FIG. 16.

An ADF according to another embodiment of the present invention is described with reference to FIGS. 2 and 18. FIG. 18 illustrates a plain view of the ADF 403 according to another embodiment of the present invention. According to the present embodiment, there is no need to reverse and discharge a document, and thus productivity in the duplex document scanning operation can be increased. In addition, a scanned document can be conveniently collected.

The ADF 403 illustrated in FIG. 18 is a modification of the ADF 402 illustrated in FIG. 16, and the ADF 403 includes a sheet discharging and stacking tray 58*a*, an ADF handle 60, a right handle 60*a*, and a backside knob 61. The sheet discharging and stacking tray 58*a* is configured to be pulled out toward a front side. That is, the sheet discharging and stacking tray 58*a* can be pulled open and pushed shut in directions of arrows "k" and "l," respectively in FIG. 18. The ADF handle 60 is provided on one side of the ADF 403, and a concave is formed at a front side surface of the right handle 60*a* to serve as the lever-type backside knob 61. Accordingly, the sheet discharging and stacking tray 58*a* can be pulled out toward the front side. With this configuration, a scanned document can be conveniently collected from the ADF 403.

In the ADF 403 illustrated FIG. 18, the discharging and stacking tray 58*a* may have a slope (not illustrated) similar to the slope of the discharge tray 59.

Figure 19:
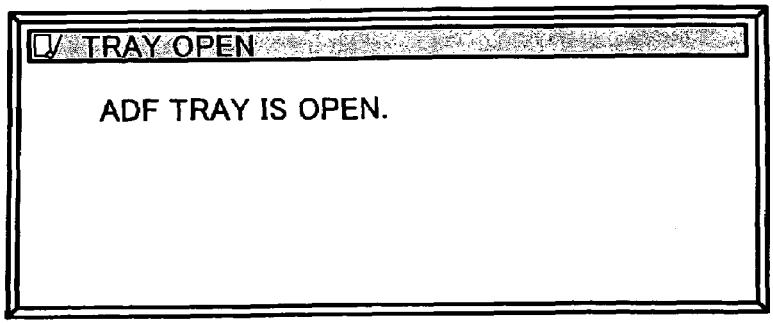
FIG. 19 is a plain view of an ADF according to another exemplary embodiment of the present invention.

In the ADF 403, a message indicating that the discharging and stacking tray 58*a* (i.e., tray) is open may be displayed on the touch panel screen of the operation unit 211. In this case, a tray HP (home position) sensor 63 is provided at a rear position of the discharging and stacking tray 58*a* to detect whether the discharging and stacking tray 58*a* is open or closed. Therefore, when it is detected, based on information sent from the tray HP sensor 63, that the discharging and stacking tray 58*a* is open, the ADF 403 can inform the image forming apparatus 200 that the cover is open, and the warning message as illustrated in FIG. 19 is displayed.

In this way, according to the present embodiment, a user is warned of incomplete storage of the discharging and stacking tray 58*a*. Since the touch panel screen of the operation unit 211 displays the warning message indicating that the discharging and stacking tray 58*a* is open, the user can immediately take an appropriate action of closing the discharging and stacking tray 58*a*, if it is open.

In the ADF 403, a discharge tray drive motor (not illustrated) may be provided to drive and move the discharging and stacking tray 58*a*, so that the discharging and stacking tray 58*a* is automatically pulled out and pushed in. The home position of the discharging and stacking tray 58*a* can be detected by the tray HP sensor 63 illustrated in FIG. 18. Then, a distance of the discharging and stacking tray 58*a* from its home position is controlled, and a distance by which the discharging and stacking tray 58*a* should be pulled out or pushed in is determined.

In the present example, an automatic pull-out or push-in operation of the discharging and stacking mechanism 58*a* is performed by touching a button (not illustrated) displayed on the touch panel screen of the operation unit 211. The button may be indicated as "automatic tray opening/closing" button, for example. After a discharged document is removed, a user lightly pushes the discharging and stacking tray 58*a* toward the home position, so that the discharging and stacking tray 58*a* is automatically moved to the home position to be stored. Thus configured, the discharging and stacking tray 58*a* can be opened or closed automatically and conveniently, with no need for assistance from a user.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an automatic document conveying apparatus comprising:

a table configured to hold thereon a document bundle;

a first conveyance path configured to reverse and convey a document of the document bundle, and including a sensor for detecting a size of the document;

a scanning device configured to scan the document conveyed by the first conveyance path;

first and second switchback mechanisms each provided at a downstream position of the scanning device to switch back and convey the document, the second switchback mechanism communicating with the first conveyance path; and a second conveyance path configured to guide the document from the scanning device to any one of the first and second switchback mechanisms, to reverse and convey the document from the first switchback mechanism to the second switchback mechanism, and to discharge the document, wherein the document is reversed and conveyed by the first conveyance path through the scanning device without being scanned, with a first surface of the document facing the scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor, and thereafter, the document is reversed and conveyed by the first conveyance path to the scanning device to have the first surface of the document scanned.

2. The image forming apparatus as described in claim 1, wherein, after the first surface of the document is scanned, the document is guided to the second switchback mechanism by the second conveyance path, switched back by the second switchback mechanism, and reversed and conveyed by the first conveyance path to the scanning device to have a second surface of the document scanned.

3. The image forming apparatus as described in claim 2, wherein the first switchback mechanism comprises:

a first roller pair configured to rotate to convey the document sent from the scanning device into the first switchback mechanism; and a second roller pair provided at a downstream position of the first roller pair to rotate in any one of first and second directions; and a discharge path configured to discharge the document conveyed by the second roller pair from the first switchback mechanism, wherein the first and second roller pairs rotate in the first direction to receive a first document into the first switchback mechanism, and wherein, after a rear end of the first document passes the first roller pair, the second roller pair starts rotating in the second direction to discharge the first document from the first switchback mechanism while receiving a second document sent from the scanning device into the first switchback mechanism.

4. An image forming apparatus comprising:

automatic document conveying means comprising:

holding means for holding thereon a document bundle;

first conveying means for reversing and conveying a document of the document bundle, and including detecting means for detecting a size of the document;

scanning means for scanning the document conveyed by the first conveying means;

first and second switchbacking means each provided at a downstream position of the scanning means for switching back and conveying the document, the second switchbacking means communicating with the first conveying means; and second conveying means for guiding the document from the scanning means to any one of the first and second switchbacking means, for reversing and conveying the document from the first switchbacking means to the second switchbacking means, and for discharging the document, wherein the document is reversed and conveyed by the first conveying means through the scanning means without being scanned, with a first surface of the document facing the scanning means, guided to the first switchbacking means by the second conveying means, switched back by the first switchbacking means, reversed and conveyed to the second switchbacking means by the second conveying means, and switched back by the second switchbacking means to detect a size of the document based on information sent from the detecting means, and thereafter, the document is reversed and conveyed by the first conveying means to the scanning means to have the first surface of the document scanned.

5. The image forming apparatus as described in claim 4, wherein, after the first surface of the document is scanned, the document is guided to the second switchbacking means by the second conveying means, switched back by the second switchbacking means, and reversed and conveyed by the first conveying means to the scanning means to have a second surface of the document scanned.

6. The image forming apparatus as described in claim 5, wherein the first switchbacking means comprises:

first roller means for rotating to convey the document sent from the scanning means into the first switchbacking means; and second roller means provided at a downstream position of the first roller means for rotating in any one of first and second directions; and discharging means for discharging the document conveyed by the second roller means from the first switchbacking means, wherein the first and second roller means rotate in the first direction to receive a first document into the first switchbacking means, and wherein, after a rear end of the first document passes the first roller means, the second roller means starts rotating in the second direction to discharge the first document from the first switchbacking means while receiving a second document sent from the scanning means into the first switchbacking means.

7. A method of automatically conveying documents, comprising:

setting a document bundle on a document table;

reversing and conveying a document of the document bundle along a first conveyance path through a scanning device without being scanned, with a first surface of the document facing the scanning device to detect a size of the document based on information sent from a sensor included in the first conveyance path;

guiding the document along the second conveyance path to a first switchback mechanism;

switching back the document by the first switchback mechanism;

reversing and conveying the document to a second switchback mechanism along the second conveyance path;

switching back the document by the second switchback mechanism;

reversing and conveying the document along the first conveyance path to the scanning device;

scanning the first surface of the document by the scanning device;

guiding the document to the first switchback mechanism along the second conveyance path;

switching back the document by the first switchback mechanism; and reversing and discharging the document along the second conveyance path.

8. The method as describe in claim 7, wherein the scanning step further comprises:

guiding the document along the second conveyance path to the second switchback mechanism upon completion of scanning of the first surface of the document;

switching back the document by the second switchback mechanism;

reversing and conveying the document along the first conveyance path to the scanning device; and scanning a second surface of the document by the scanning device.

9. The method as described in claim 8, wherein the step of switching back by the first switchback mechanism further comprises:

rotating a first roller pair and a second roller pair provided at a downstream position of the first roller pair in a first direction of receiving a first document into the first switchback mechanism;

rotating, after a rear end of the first document passes the first roller pair, the second roller pair in a second direction of discharging the first document from the first switchback mechanism; and discharging the first document from the first switchback mechanism through a discharge path while receiving a second document sent from the scanning device into the first switchback mechanism.

10. An image scanning apparatus comprising:

an automatic document conveying apparatus comprising:

a table configured to hold thereon a document bundle;

a first conveyance path configured to reverse and convey a document of the document bundle and including a sensor for detecting a size of the document;

a scanning device configured to scan the document conveyed by the first conveyance path;

first and second switchback mechanisms each provided at a downstream position of the scanning device to switch back and convey the document, the second switchback mechanism communicating with the first conveyance path; and a second conveyance path configured to guide the document from the scanning device to any one of the first and second switchback mechanisms, to reverse and convey the document from the first switchback mechanism to the second switchback mechanism, and to discharge the document, wherein the document is reversed and conveyed by the first conveyance path through the scanning device without being scanned, with a first surface of the document facing the scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor, and thereafter, the document is reversed and conveyed by the first conveyance path to the scanning device to have the first surface of the document scanned.

11. The image scanning apparatus as described in claim 10, wherein, after the first surface of the document is scanned, the document is guided to the second switchback mechanism by the second conveyance path, switched back by the second switchback mechanism and reversed and conveyed by the first conveyance path to the scanning device to have a second surface of the document scanned.

12. The image scanning apparatus as described in claim 11, wherein the first switchback mechanism comprises:

a first roller pair configured to rotate to convey the document sent from the scanning device into the first switchback mechanism; and a second roller pair provided at a downstream position of the first roller pair to rotate in any one of first and second directions; and a discharge path configured to discharge the document conveyed by the second roller pair from the first switchback mechanism, wherein the first and second roller pairs rotate in the first direction to receive a first document into the first switchback mechanism, and wherein, after a rear end of the first document passes the first roller pair, the second roller pair starts rotating in the second direction to discharge the first document from the first switchback mechanism while receiving a second document sent from the scanning device into the first switchback mechanism.

13. An image scanning apparatus comprising:

automatic document conveying means comprising:

holding means for holding thereon a document bundle;

first conveying means for reversing and conveying a document of the document bundle, and including detecting means for detecting a size of the document;

scanning means for scanning the document conveyed by the first conveying means;

first and second switchback means each provided at a downstream position of the scanning means for switching back and conveying the document, the second switchbacking means communicating with the first conveyance means; and second conveyance means for guiding the document from the scanning means to any one of the first and second switchbacking means, for reversing and conveying the document from the first switchbacking means to the second switchbacking means, and for discharging the document, wherein the document is reversed and conveyed by the first conveying means through the scanning means without being scanned, with a first surface of the document facing the scanning means, guided to the first switchbacking means by the second conveying means, switched back by the first switchbacking means, reversed and conveyed to the second switchbacking means by the second conveying means, and switched back by the second switchbacking means to detect a size of the document based on information sent from the detecting means, and thereafter, the document is reversed and conveyed by the first conveying means to the scanning means to have the first surface of the document scanned.

14. The image scanning apparatus as described in claim 13, wherein, after the first surface of the document is scanned, the document is guided to the second switchbacking means by the second conveying means, switched back by the second switchbacking means, and reversed and conveyed by the first conveying means to the scanning means to have a second surface of the document scanned.

15. The image scanning apparatus as described in claim 14, wherein the first switchbacking means comprises:

first roller means for rotating to convey the document sent from the scanning means into the first switchbacking means; and second roller means provided at a downstream position of the first roller means for rotating in any one of first and second directions; and discharging means for discharging the document conveyed by the second roller means from the first switchbacking means, wherein the first and second roller means rotate in the first direction to receive a first document into the first switchbacking means, and wherein, after a rear end of the first document passes the first roller means, the second roller means starts rotating in the second direction to discharge the first document from the first switchbacking means while receiving a second document sent from the scanning means into the first switchbacking means.

16. An automatic document conveying apparatus comprising:

a table configured to hold thereon a document bundle;

a first conveyance path configured to reverse and convey a document of the document bundle to a scanning position where the document is scanned by an external scanning device, and including a sensor for detecting a size of the document;

first and second switchback mechanisms each provided at a downstream position of the scanning position to switch back and convey the document, the second switchback mechanism communicating with the first conveyance path; and a second conveyance path configured to guide the document from the scanning device to any one of the first and second switchback mechanisms, to reverse and convey the document from the first switchback mechanism to the second switchback mechanism, and to discharge the document, wherein the document is reversed and conveyed by the first conveyance path through the scanning position without being scanned, with a first surface of the document facing the external scanning device, guided to the first switchback mechanism by the second conveyance path, switched back by the first switchback mechanism, reversed and conveyed to the second switchback mechanism by the second conveyance path, and switched back by the second switchback mechanism to detect a size of the document based on information sent from the sensor, and thereafter, the document is reversed and conveyed by the first conveyance path to the scanning position to have the first surface of the document scanned.

17. The automatic document conveying apparatus as described in claim 16, wherein, after the first surface of the document is scanned, the document is guided to the second switchback mechanism by the second conveyance path, switched back by the second switchback mechanism, and reversed and conveyed by the first conveyance path to the scanning position to have a second surface of the document scanned.

18. The automatic document conveying apparatus as described in claim 17, wherein the first switchback mechanism comprises:

a first roller pair configured to rotate to convey the document sent from the scanning position into the first switchback mechanism; and a second roller pair provided at a downstream position of the first roller pair to rotate in any one of first and second directions; and a discharge path configured to discharge the document conveyed by the second roller pair from the first switchback mechanism, wherein the first and second roller pairs rotate in the first direction to receive a first document into the first switchback mechanism, and wherein, after a rear end of the first document passes the first roller pair, the second roller pair starts rotating in the second direction to discharge the first document from the first switchback mechanism while receiving a second document sent from the scanning position into the first switchback mechanism.

19. An automatic document conveying apparatus comprising:

holding means for holding thereon a document bundle;

first conveying means for reversing and conveying a document of the document bundle to a scanning position where the document is scanned by external scanning means, and including detecting means for detecting a size of the document;

first and second switchbacking means each provided at a downstream position of the scanning position for switching back and conveying the document, the second switchbacking means communicating with the first conveying means; and second conveying means for guiding the document from the scanning position to any one of the first and second switchbacking means, for reversing and conveying the document from the first switchbacking means to the second switchbacking means, and for discharging the document, wherein the document is reversed and conveyed by the first conveying means through the scanning position without being scanned, with a first surface of the document facing the external scanning means, guided to the first switchbacking means by the second conveying means, switched back by the first switchbacking means, reversed and conveyed to the second switchbacking means by the second conveying means, and switched back by the second switchbacking means to detect a size of the document based on information sent from the detecting means, and thereafter, the document is reversed and conveyed by the first conveying means to the scanning position to have the first surface of the document scanned.

20. The automatic document conveying apparatus as described in claim 19, wherein, after the first surface of the document is scanned, the document is guided to the second switchbacking means by the second conveying means, switched back by the second switchbacking means, and reversed and conveyed by the first conveying means to the scanning position to have a second surface of the document scanned.

21. The automatic document conveying apparatus as described in claim 20, wherein the first switchbacking means comprises:

first roller means for rotating to convey the document sent from the scanning position into the first switchbacking means; and second roller means provided at a downstream position of the first roller means for rotating in any one of first and second directions; and discharging means for discharging the document conveyed by the second roller means from the first switchbacking means, wherein the first and second roller means rotate in the first direction to receive a first document into the first switchbacking means, and wherein, after a rear end of the first document passes the first roller means, the second roller means starts rotating in the second direction to discharge the first document from the first switchbacking means while receiving a second document sent from the scanning position into the first switchbacking means.

* * * * *